US012018556B2

(12) United States Patent
Mahajan et al.

(10) Patent No.: US 12,018,556 B2
(45) Date of Patent: Jun. 25, 2024

(54) SYSTEMS AND METHODS OF CONTROLLING DOWNHOLE BEHAVIOR

(71) Applicant: Schlumberger Technology Corporation, Sugar Land, TX (US)

(72) Inventors: Manoj D. Mahajan, Houston, TX (US); Scott Richard Woolston, Provo, UT (US); Huntington Tracy Hall, Provo, UT (US); Jonathan D. Marshall, Springville, UT (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 61 days.

(21) Appl. No.: 17/272,370

(22) PCT Filed: Aug. 27, 2019

(86) PCT No.: PCT/US2019/048251
§ 371 (c)(1),
(2) Date: Mar. 1, 2021

(87) PCT Pub. No.: WO2020/046871
PCT Pub. Date: Mar. 5, 2020

(65) Prior Publication Data

US 2021/0324726 A1 Oct. 21, 2021

Related U.S. Application Data

(60) Provisional application No. 62/724,436, filed on Aug. 29, 2018.

(51) Int. Cl.
*E21B 44/04* (2006.01)
*E21B 10/43* (2006.01)
(Continued)

(52) U.S. Cl.
CPC ..... *E21B 44/04* (2013.01); *E21B 10/43* (2013.01); *E21B 10/62* (2013.01); *E21B 44/00* (2013.01); *E21B 47/013* (2020.05)

(58) Field of Classification Search
CPC ..... E21B 44/04; E21B 47/013; E21B 10/43; E21B 10/62; E21B 44/00
See application file for complete search history.

(56) References Cited

U.S. PATENT DOCUMENTS 7,198,119 B1 4/2007 Hall et al.
7,225,886 B1 6/2007 Hall
(Continued)

FOREIGN PATENT DOCUMENTS

CN 106715822 A 5/2017
WO 2010148286 A2 12/2010
WO WO-2019005709 A1 * 1/2019 ..... E21B 23/006

OTHER PUBLICATIONS

International Search Report and Written Opinion issued in International Patent application PCT/US2019/048251 dated Dec. 16, 2019, 14 pages.
(Continued)

*Primary Examiner* — Nicole Coy

(57) ABSTRACT

A bit used in a downhole environment has an active element that is movable relative to the bit. The bit is rotated in the downhole environment, and at least one downhole parameter is measured. The at least one downhole parameter is compared against a target parameter value, and when the at least one downhole parameter is beyond a threshold value of the target parameter value, the active element is selectively relative to the bit. Movement of the active element alters the proportion of the weight on the active element as compared to the other cutting structure of the bit. Changing the proportion of weight can be used to reduce the depth of cut
(Continued)

of the cutting structure and to reduce or eliminate motor stall or stick-slip behavior.

18 Claims, 12 Drawing Sheets

(51) Int. Cl.
*E21B 10/62* (2006.01)
*E21B 44/00* (2006.01)
*E21B 47/013* (2012.01)

(56) References Cited

U.S. PATENT DOCUMENTS 7,258,179 B2 8/2007 Hall
7,270,196 B2 9/2007 Hall
7,328,755 B2 2/2008 Hall
7,337,858 B2 3/2008 Hall
7,360,610 B2 4/2008 Hall
7,392,857 B1 7/2008 Hall
7,426,968 B2 9/2008 Hall et al.
7,484,576 B2 * 2/2009 Hall ..... E21B 4/06 175/73
7,497,279 B2 3/2009 Hall et al.
7,506,701 B2 3/2009 Hall et al.
7,506,706 B2 3/2009 Hall et al.
7,533,737 B2 5/2009 Hall et al.
7,549,489 B2 6/2009 Hall et al.
7,571,780 B2 8/2009 Hall et al.
7,571,782 B2 8/2009 Hall et al.
7,591,327 B2 9/2009 Hall et al.
7,617,886 B2 11/2009 Hall
7,624,824 B2 12/2009 Hall et al.
7,641,002 B2 1/2010 Hall et al.
7,641,003 B2 1/2010 Hall et al.
7,661,487 B2 2/2010 Hall et al.
7,694,756 B2 4/2010 Hall et al.
7,721,826 B2 5/2010 Hall et al.
7,730,972 B2 6/2010 Hall et al.
7,730,975 B2 6/2010 Hall et al.
7,753,144 B2 7/2010 Hall et al.
7,866,416 B2 1/2011 Hall et al.
7,900,720 B2 3/2011 Hall et al.
7,954,401 B2 6/2011 Hall et al.
7,967,083 B2 6/2011 Hall et al.
8,011,457 B2 9/2011 Hall et al.
8,020,471 B2 9/2011 Hall et al.
8,056,651 B2 11/2011 Turner et al.
8,061,455 B2 11/2011 Beuershausen
8,087,479 B2 1/2012 Kulkarni et al.
8,121,971 B2 * 2/2012 Edwards ..... E21B 44/00 706/50
8,130,117 B2 3/2012 Hall et al.
8,205,686 B2 6/2012 Beuershausen
8,225,883 B2 7/2012 Hall et al.
8,240,399 B2 8/2012 Kulkarni et al.
8,281,882 B2 10/2012 Hall et al.
8,297,375 B2 10/2012 Hall et al.
8,297,378 B2 10/2012 Hall et al.
8,307,919 B2 11/2012 Hall et al.
8,316,964 B2 11/2012 Hall et al.
8,499,857 B2 8/2013 Hall et al.
8,950,517 B2 2/2015 Hall et al.
9,080,399 B2 7/2015 Oesterberg
9,097,065 B2 8/2015 Schwefe et al.
9,103,171 B2 8/2015 Hanford
9,103,175 B2 8/2015 Schwefe
9,140,074 B2 9/2015 Schwefe et al.
9,181,756 B2 11/2015 Schwefe et al.
9,255,449 B2 2/2016 Schwefe et al.
9,255,450 B2 2/2016 Jain et al.
9,267,329 B2 2/2016 Bilen
9,279,293 B2 3/2016 Izbinski
9,399,892 B2 7/2016 Do et al.
9,663,995 B2 5/2017 Jain
9,695,641 B2 7/2017 Schen et al.
9,708,859 B2 7/2017 Jain et al.
9,759,014 B2 9/2017 Do et al.
9,915,138 B2 * 3/2018 Schwefe ..... E21B 10/42
9,932,780 B2 4/2018 Spencer et al.
9,938,814 B2 4/2018 Hay
9,970,236 B2 5/2018 Nanayakkara et al.
10,655,396 B2 * 5/2020 Eve ..... E21B 10/42
2002/0070050 A1 6/2002 Wassell
2007/0221417 A1 9/2007 Hall
2008/0164062 A1 7/2008 Brackin
2009/0132458 A1 5/2009 Edwards
2010/0148286 A1 6/2010 Kim
2010/0198996 A1 * 8/2010 Shiraki ..... G06F 3/1234 710/19
2012/0255788 A1 10/2012 Schwefe
2014/0305653 A1 10/2014 Lee et al.
2015/0144401 A1 5/2015 Nagaraj et al.
2016/0230529 A1 8/2016 Schwefe et al.
2016/0313217 A1 10/2016 Gerbaud et al.
2017/0074047 A1 3/2017 Jain
2017/0159370 A1 6/2017 Evans et al.
2017/0175454 A1 6/2017 Ricks et al.
2017/0175455 A1 6/2017 Jain et al.
2017/0204677 A1 7/2017 Yu et al.
2017/0275951 A1 9/2017 Thomas
2017/0362898 A1 12/2017 Do et al.
2018/0030786 A1 2/2018 Dunbar et al.

OTHER PUBLICATIONS

International Preliminary Report on Patentability issued in International Patent application PCT/US2019/048251 dated Mar. 11, 2021, 11 pages.

* cited by examiner

SYSTEMS AND METHODS OF CONTROLLING DOWNHOLE BEHAVIOR

CROSS-REFERENCE TO RELATED APPLICATIONS

The present application is the U.S. national phase of International Patent Application No. PCT/US2019/048251, filed Aug. 27, 2019, and entitled "Systems and Methods of Controlling Downhole Behavior," which claims priority to, and the benefit of, U.S. Patent Application No. 62/724,436, filed Aug. 29, 2019, which is expressly incorporated herein by this reference in its entirety.

BACKGROUND

In underground drilling, a drill bit is used to drill a wellbore into subterranean formations. The drill bit is attached to sections of pipe that reach back to the surface. The attached sections of pipe are connected to other downhole tools and are collectively called the drill string. The section of the drill string that is located near the bottom of the borehole is called the bottomhole assembly (BHA). The BHA typically includes the drill bit, sensors, batteries, telemetry devices, and other equipment located near the drill bit. A drilling fluid, sometimes called drilling mud, is provided from the surface to the drill bit through the pipe that forms the drill string. The primary functions of the drilling fluid are to cool the drill bit and carry drill cuttings away from the bottom of the borehole and up through the annulus between the drill string and the borehole wall. Conventionally, sensors are placed in the BHA or on the drill bit to measure downhole drilling parameters or other parameters. The sensors measure downhole parameters that relate to the behavior of the bit in the downhole environment.

SUMMARY

In some embodiments, a system for drilling a wellbore includes a bottomhole assembly including a cutting tool having a body. An active element is connected to the body and is movable relative to the body at least partially in a longitudinal direction of the cutting tool. An actuator is coupled to the active element and configured to move the active element. At least one sensor is configured to measure at least one downhole parameter, and a processor is in communication with the at least one sensor and the actuator, for moving the active element based on a difference between the at least one downhole parameter and a target parameter.

In some embodiments, a system for drilling a wellbore includes a bit having a longitudinal axis about which the bit is rotatable. An active element is positioned in or on the bit and is relative to the bit along the longitudinal axis. The system also includes an actuator that applies a force to the active element to move the active element, and at least one sensor that measures at least one downhole parameter. A processor of the system is in communication with the at least one sensor and the actuator, in order to move the active element toward an extended state when the at least one downhole parameter exceeds an actuation threshold value and move the active element toward a retracted state when the at least one downhole parameter is within a deactivation threshold value.

In some embodiments, a method of controlling a bit in a downhole environment includes tripping a bit into a downhole environment where the bit has an active element that is movable relative to a longitudinal axis of the bit. The method further includes applying torque to the bit in the downhole environment, measuring at least one downhole parameter, and comparing the at least one downhole parameter against a target parameter value. When the at least one downhole parameter is beyond a threshold value of the target parameter value, the active element is moved relative to the bit. Moving the active element can apply a force to the formation or other workpiece being cut by the bit.

This summary is provided to introduce a selection of concepts that are further described in the detailed description. This summary is not intended to identify key or essential features of the claimed subject matter, nor is it intended to be used as an aid in limiting the scope of the claimed subject matter. Additional features and aspects of embodiments of the disclosure will be set forth herein, and in part will be obvious from the description, or may be learned by the practice of such embodiments.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 5-1 is a side view of a cutting element exhibiting a first depth of cut, according to at least one embodiment of the present disclosure;

FIG. 5-2 is a side view of the cutting element of FIG. 5-1 exhibiting a second depth of cut, according to at least one embodiment of the present disclosure;

FIG. 5-3 is a side view of the cutting element of FIG. 5-1 exhibiting a third depth of cut, according to at least one embodiment of the present disclosure;

FIG. 9-1 is a side cross-sectional view of a bit with an active element in a downhole environment, according to at least one embodiment of the present disclosure;

FIG. 9-2 is a side cross-sectional view of the bit of FIG. 9 with an actuated active element in a downhole environment, according to at least one embodiment of the present disclosure;

DETAILED DESCRIPTION

This disclosure generally relates to devices, systems, and methods for measuring downhole parameters. Additional aspects of the disclosure relate to moving an active element to adjust behavior of a downhole tool based at least partially upon a downhole parameter. More particularly, aspects of the present disclosure relate to the dynamic use of at least one active element positioned in a downhole cutting tool to apply a force to a formation and change the downhole performance of the downhole cutting tool.

Figure 1:
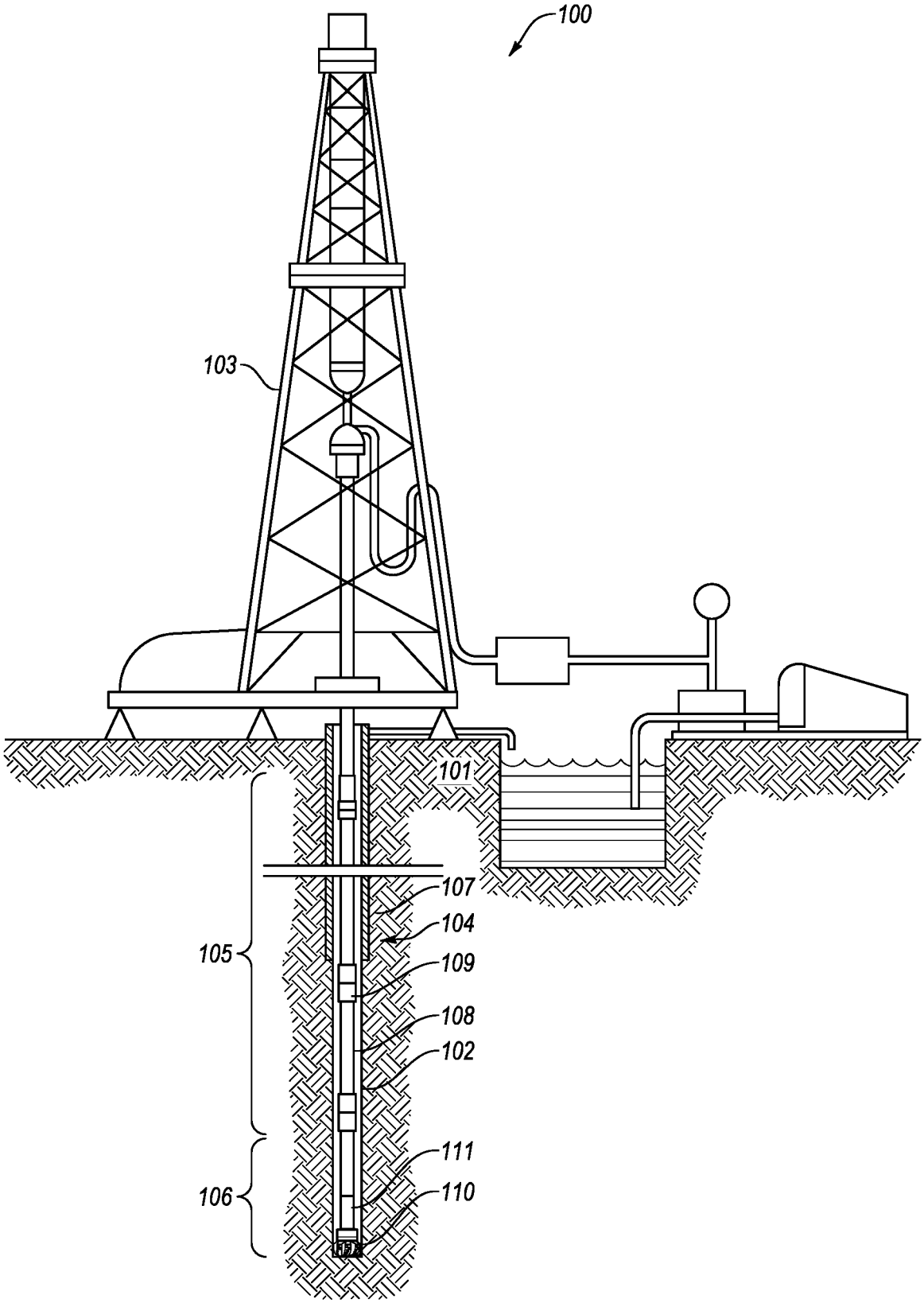
FIG. 1 is a schematic side view of a drilling system, according to at least one embodiment of the present disclosure.

FIG. 1 shows one example of a drilling system 100 for drilling an earth formation 101 to form a wellbore 102. The drilling system 100 includes a drill rig 103 used to turn a drilling tool assembly 104 which extends downward into the wellbore 102. The drilling tool assembly 104 includes a drill string 105 and a bottomhole assembly ("BHA") 106 attached to the downhole end of the drill string 105. A cutting tool such as an underreamer, mill, or drill bit 110 may be attached to, or included as part of, the BHA 106. In the illustrated embodiment, the drill bit 110 is included at the downhole end of the BHA 106.

The drill string 105 may include several joints of drill pipe 108 connected end-to-end through tool joints 109. The drill string 105 transmits drilling fluid through a central bore and transmits rotational power from the drill rig 103 to the BHA 106. In some embodiments, the drill string 105 may further include additional components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled.

The BHA 106 may include the bit 110 or other components. An example BHA 106 may include additional or other components (e.g., coupled between the drill string 105 and the bit 110). Examples of additional BHA components include drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing.

In general, the drilling system 100 may include other drilling components and accessories, such as special valves (e.g., kelly cocks, blowout preventers, and safety valves). Additional components included in the drilling system 100 may be considered a part of the drilling tool assembly 104, the drill string 105, or a part of the BHA 106 depending on the locations of the components in the drilling system 100.

The drilling system 100 optionally includes one or more downhole motors 111 that rotates the drill bit 110. A downhole motor 111 may be included in addition to, or instead of, a surface rotary system, such as a top drive or rotary table in the rig 103. A downhole motor 111 can include a turbodrill, progressive displacement motor (PDM), other mud motor driven by the drilling fluid, an electric motor, or other motors positioned downhole of the surface. The downhole motors 111 are capable of providing torque to the bit 110 in order to rotate the bit to facilitate removal of material from the formation 101. For example, a PDM mud motor is driven by the fluid pressure of drilling fluid pumped downhole through the drill string 105 that is urged through a series of cavities in the PDM mud motor to rotate a rotor of the PDM mud motor. The rotation of the rotor converts the downhole flow and pressure of the drilling fluid to torque that rotates a drive shaft. The drive shaft is coupled to the bit 110 and rotates the bit. Turbodrills operate by flowing fluid through a series of turbines and causing rotors within the turbines to rotate. The turbine rotors are attached to a shaft that, in turn, rotates the drill bit relative to the drill string.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits, roller cone bits, or hybrids of fixed and roller cone bits. In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to surface or may be allowed to fall downhole.

In some embodiments, the bit 110 includes an active element that is moveable in a longitudinal direction relative to the bit to apply a force to the formation and to remove or change the proportion of the weight on bit (WOB) that is borne by the cutting structure of the bit 110. For instance, assuming constant WOB, moving the active element axially downward may cause the active element to bear a higher proportion of the weight, and causing a reduced proportion of weight to be distributed to the blades, roller cones, cutting elements on the blades or cones, or other cutting structure. Reducing the absolute or proportion of the weight on the cutting structure may reduce the engagement of the cutting elements with the formation (e.g., by reducing depth of cut), allowing the cutting elements (and, hence, the bit 110) to rotate with less resistance from the formation. The weight on the cutting structure can be reported or considered as a nominal value (e.g., 10,000 pounds of force (44.5 kN)), or the weight on the cutting structure can be a relative number that is proportional to the WOB. For example, in some examples, before actuation of the active element(s), the weight on the cutting structure may be between 80% and 100% of the WOB), and during actuation of the active element(s), the weight on the cutting structure may be between 40% and 90% of the WOB.

Reducing the weight on the cutting structure allows the depth of cut to be reduced, and the bit to rotate more consistently or freely. The reduced resistance to rotation can reduce or prevent undesirable downhole dynamics, such as stick-slip or motor stall. The active element may be moveable relative to the bit by a hydraulic pressure, a pneumatic pressure, a magnetic force, a mechanical force, one or more electric motors, or by another actuation mechanism. The active element is moved in response to trigger events. For example, a trigger event could occur when one or more sensors provide information regarding downhole parameters that one or more processors compare against a target parameter value or a threshold value. When the downhole parameters deviate from the target parameter value, exceed or drop below an actuation threshold value, or are otherwise used, a trigger event may occur and the processor(s) may actuate the active element.

Stick-slip refers to an irregular movement of drill bit 110 as the drill bit 110 rotates relative to the formation 101. The cutting elements or other portion of the drill bit 110 engage with the formation 101, which resists the rotation of the drill bit 110, slowing the rotation of the drill bit 110, known as "sticking". As torque may still be applied to the downhole system, sticking can cause torsional energy to build-up. At least some of that built-up energy can be rapidly released when the drill bit 110 "slips" (which may include fully disengaging from the formation 101 or merely beginning to remove material at a greater rate) upon the development and release of sufficient torsional energy in the BHA 106, the drill pipe 108, or other portions of the drill string 105. The resulting slip behavior can produce very high rotational rates of the BHA 106 and drill bit 110, potentially damaging components of the BHA 106 or drill bit 110 and reducing the rate of penetration (ROP) of the drilling system 100, or the useful life of the drill bit 110 or BHA 106.

Motor stall can occur when despite continued fluid flow, the rotational rate of the downhole motor 111 falls and the motor stops rotating. Motor stall can be the result of low differential pressure across the motor, producing insufficient torque from the motor and potentially leading to damage to the downhole motor 111. Motor stall can also be the result of high differential pressure across the downhole motor 111, which can also damage the downhole motor 111. Motor stall may, in some cases, damage the downhole motor 111 or create a pressure wave in the drilling fluid column that may damage the downhole motor 111 or other downhole elements. The damage to the downhole motor 111 can include rupturing of seals or damage to the stator or rotor that renders the motor inefficient or unable to produce torque in response to fluid flow.

Figure 2:
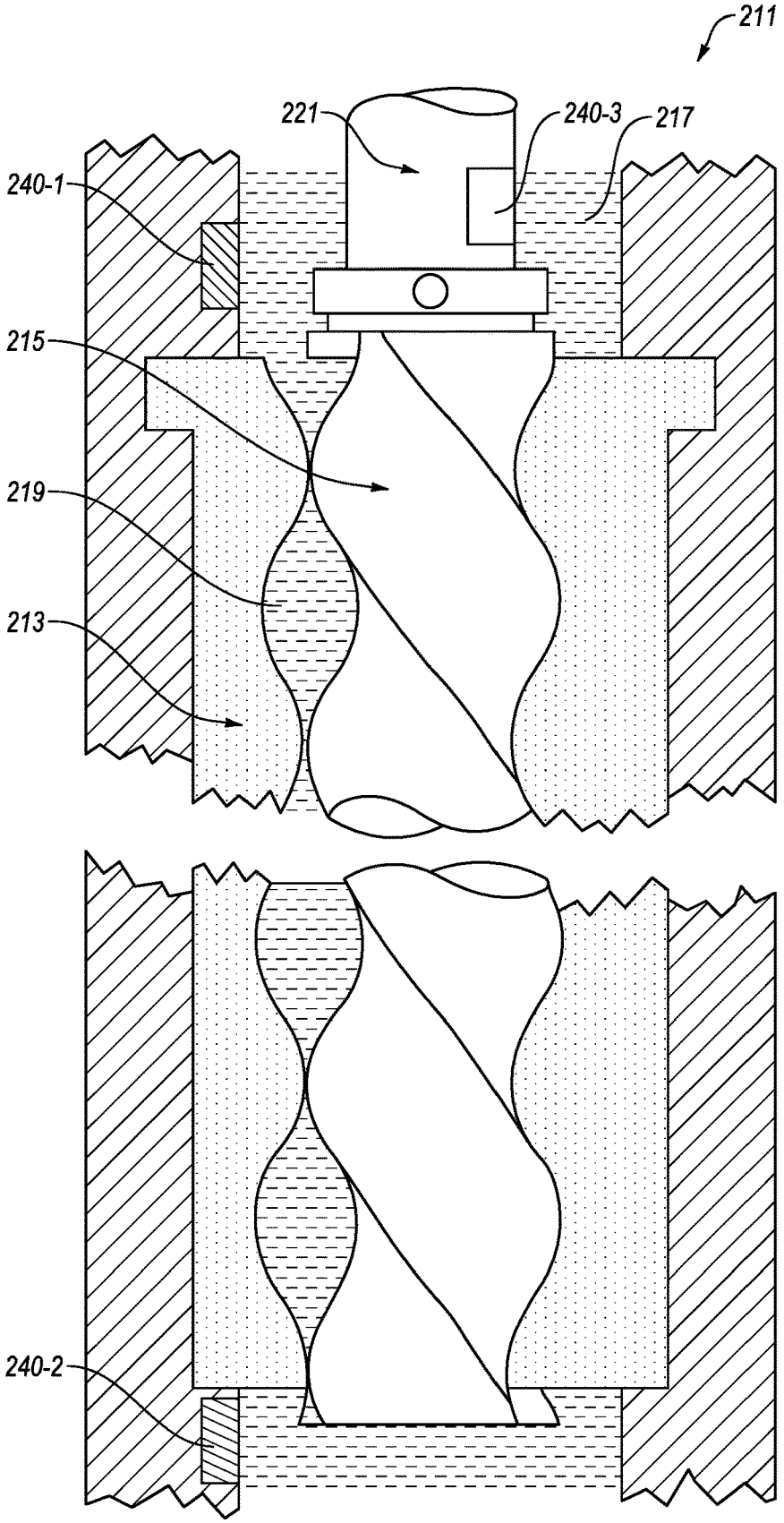
FIG. 2 is a cross-sectional view of a downhole motor, according to at least one embodiment of the present disclosure.

FIG. 2 is a side cross-sectional view of an embodiment of a downhole motor 211 with a stator 213 and a rotor 215. The downhole motor 211 is illustrative of a PDM, in which the fluid 217 flows through the mud motor 211 by displacing a series of cavities 219 in a longitudinal direction. In a progressive displacement cavity motor 211, the outer surface of the rotor 215 is a single helix, while the inner surface of the stator 213 is a double helix. The displacement of the cavities 219 relative to the stator 213 rotates the rotor 215 in an eccentric rotation to turn a shaft 221. The shaft 221 may drive a bit (such as bit 110 of FIG. 1) to remove material in a downhole environment.

Upon the bit experiencing stick-slip behavior, the relative rate of rotation of the rotor 215 and stator 213 may decrease (during stick) and increase (during slip), resulting in associated increases and decreases in fluid pressure, respectively. While both the sudden increase and decreases in speed and pressure may damage the mud motor 211, the stator 213 and rotor 215 may experience significant damage if the mud motor 211 stalls and the fluid pressure is able to build on only one side of the mud motor 211. Sensors 240-1, 240-2 may be positioned on either side of the mud motor 211 to measure the uphole pressure (e.g., with a first sensor 240-1), the downhole pressure (e.g., with a second sensor 240-2), or a differential pressure (e.g., by measuring a difference between the pressure experienced by the first sensor 240-1 and the second sensor 240-2).

Figure 3:
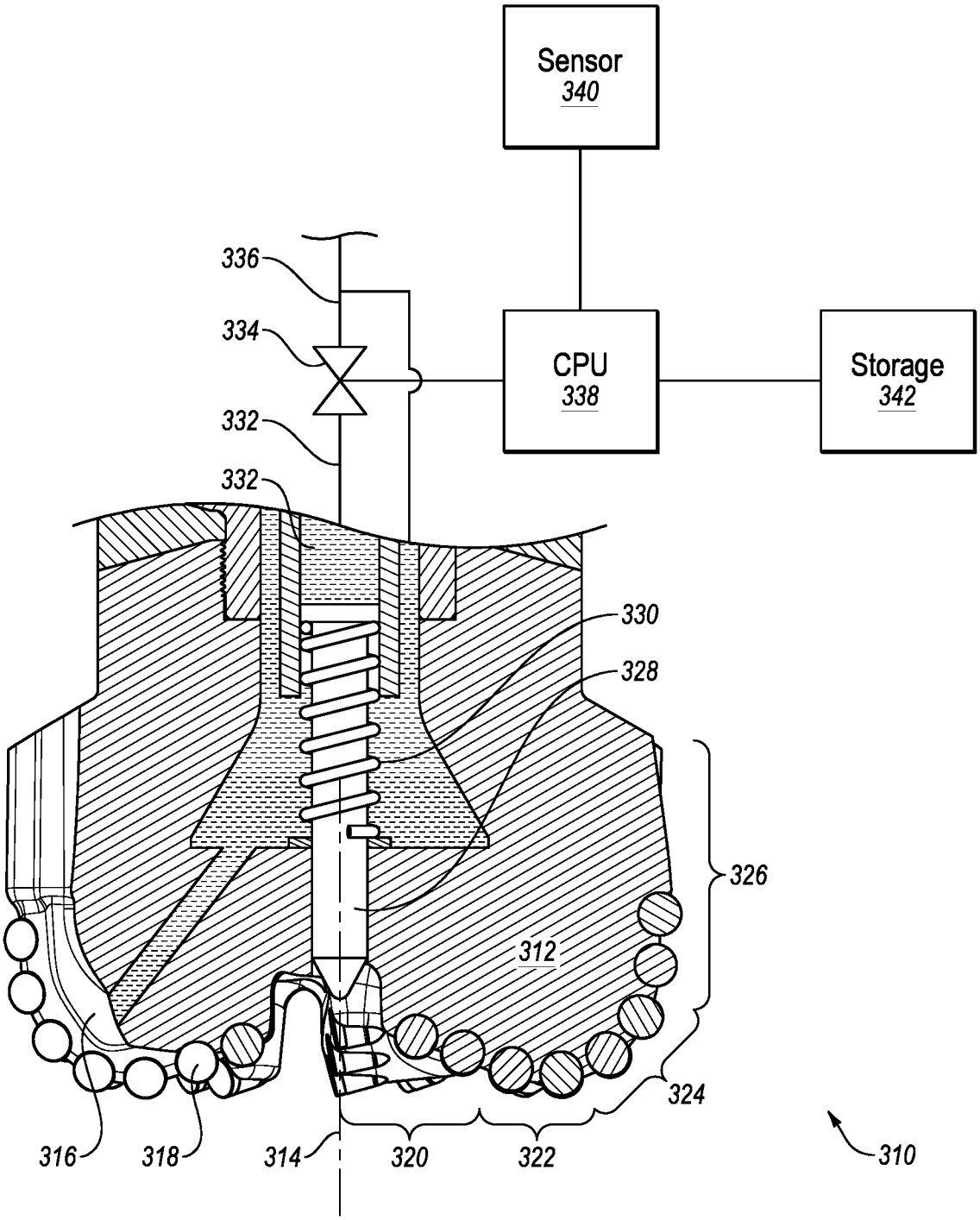
FIG. 3 is a cross-sectional view of a bit, according to at least one embodiment of the present disclosure.

FIG. 3 is a side, cross-sectional view of an embodiment of a bit 310, according to some embodiments of the present disclosure. The bit 310 includes a bit body 312 with a longitudinal rotational axis 314 about which the bit 310 rotates. The bit body 312 has one or more blades 316 protruding therefrom, with a plurality of cutting elements 318 positioned in and/or affixed to the blade 316. In some embodiments, the blades 316 include primary blades and secondary blades. For example, the primary blades and the secondary blades both extend from an outer radial edge of the bit 310 toward the longitudinal rotational axis 314, and the primary blades extend closer to the longitudinal rotational axis 314. In other words, the primary blades are longer in the radial direction. In the same or other embodiments, cutting elements 318 may be positioned one or more roller cones, or on both one or more blades 316 and one or more roller cones. For example, the bit body 312 may have at least one roller cone positioned thereon with cutting element 318 affixed to the roller cone, in addition to, or instead of, the blade(s) 316 protruding from the bit body 312.

The cutting elements 318 may include an ultrahard material. As used herein, the term "ultrahard" is understood to refer to those materials known in the art to have a grain hardness of about 1,500 HV (Vickers hardness in $kg/mm^2$) or greater. Such ultrahard materials can include but are not limited to diamond, polycrystalline diamond (PCD), hexagonal diamond (Lonsdaleite), cubic boron nitride (cBN), polycrystalline cBN (PcBN), binderless PCD or nanopolycrystalline diamond (NPD), Q-carbon, binderless PcBN, diamond-like carbon, boron suboxide, aluminum manganese boride, metal borides, tungsten carbide, boron carbon nitride, and other materials in the boron-nitrogen-carbon-oxygen system which have shown hardness values above 1,500 HV, as well as combinations of the above materials. In some embodiments, the ultrahard material may have a hardness value above 3,000 HV. In other embodiments, the ultrahard material may have a hardness value above 4,000 HV. In yet other embodiments, the ultrahard material may have a hardness value greater than 80 HRa (Rockwell hardness A).

The bit 310 has a bit profile including various regions including cone 320, nose 322, shoulder 324, and gage 326 regions. In FIG. 3, the regions are shown for a single blade 316, however, a complete cutting profile of the bit 310 includes each of the cutting elements 318 of the bit 310 when rotated into a single plane. The cutting elements 318 may be positioned on any or each of the cone 320, nose 322, shoulder 324, and gage 326 regions to remove material from the formation (e.g., formation 101 of FIG. 1) and/or to protect the bit body 312 from wear due to contact with the formation or other workpiece. The cutting elements 318 engage with a downhole workpiece (e.g., formation) to fracture, abrade, grind, shear, or otherwise mechanically remove material from the formation. While cutting elements 318 illustrated in FIG. 3 include shear cutting elements, other cutting element geometries may be used instead of or in combination with shear cutting elements. For example, apexed or pointed cutting elements, such as conical cutting elements, ridged cutting elements, or bullet cutting elements, may be employed in any or each of the regions of the bit profile described herein.

The amount of material removed from the formation with each rotation of the bit 310 about the rotational axis 314 varies depending on one or more downhole parameters. For example, downhole parameters include formation properties such as the hardness of the formation, formation fluid pressure, or the homogeneity of the formation affects the volume and rate of material removal. Additionally, downhole parameters include BHA properties including the rotational rate of the bit 310, the weight-on-bit (WOB) (i.e., the amount of force applied by the bit 310 to the formation in the longitudinal direction of the bit 310), the geometry and condition of the cutting elements 318 and/or blades 316, the placement of cutting elements 318 in the cutting profile, a drilling fluid flow rate (for flushing cuttings from the blades 316), and other BHA properties affect the volume and rate of material removal. The interaction and combination of various formation properties and BHA properties can affect the volume and rate of material removal. For example, a heavier set of cutting elements (i.e., more cutting elements in the cutting profile) may produce more or less material removal depending on a hardness of the formation, exposure height, WOB, etc.

Cutting elements 318 engaging the formation have a depth of cut (DOC), which relates to the amount of a cutting element 318 that extends into the formation while cutting. The greater the amount of the cutting element 318 extends into the formation, the higher the DOC. Accordingly, DOC is a measure of how aggressively the bit 310 removes material from the formation with each rotation. DOC can be affected by cutting element geometry and materials. For example, conical cutting elements exhibit a different DOC than shear cutting elements. DOC can be affected by cutting element orientation. A conical cutting element will exhibit a different DOC as the apex of the cutting element is oriented at different angles (e.g., rake angle) relative to the surface of the downhole workpiece. The DOC is also affected by the formation material. For example, a cutting element exhibits different DOC in formations with different hardness or porosity. The DOC can further be affected by the weight on the cutting structure. The DOC, therefore, can be reduced even with constant weight on bit, by reducing the weight on the cutting structure. For instance, by actuating an active element 328 of the bit 310, the amount of the WOB on the active element 328 can be increased, while the proportion of the WOB applied to the cutting elements 318 is decreased.

ROP relates to the rate at which the bit 310 removes material from the formation and extends the length of the wellbore. While a greater DOC may correspond to a greater ROP, an increase in DOC can also be associated with a greater amount of torque on the bit 310 and may slow the rotational rate of the bit 310, resulting in a decrease in the ROP. In some instances, a sudden increase in the DOC, such as due to a change in the formation, or sudden increase in WOB or weight on the cutting structure, may produce a sudden change in torque on the bit 310 or a change in rotational rate of the bit 310. In some cases, changes in the torque or rotational rate are detrimental to the performance or operational lifetime of the bit 310 or cutting elements 318. For example, increases in the DOC or torque on the bit, decreases in the rotational rate of the bit, or combinations thereof, may produce or be the result of stick-slip behavior or motor stall. Changes in formation properties and/or BHA properties may further produce vibration, whirl, or other undesired effects.

In some embodiments, a bit 310 according to the present disclosure is used to mitigate stick-slip, motor stall, or other undesirable downhole conditions or behaviors. For instance, the bit 310 has an active element 328. The active element 328 is optionally positioned in the bit body 312 and is movable relative to the bit body 312. While FIG. 3 illustrates the active element 328 as extending from a face of the bit and coaxial with the longitudinal rotational axis 314, the active element 328 may be positioned elsewhere in the bit 310 and/or with other orientations. For example, the active element 328 can be positioned in a blade 316 or junk slot between blades 316. In other examples, the active element 328 can move in an orientation at an angle to the longitudinal rotational axis 314.

The active element 328 at least partially protrudes from the bit 310 to contact the formation. The active element 328 has an extended state and a retracted state, and optionally protrudes from the face of the bit 310 both when in the extended and retracted states, although to differing extents. In other embodiments, the active element 328 is recessed within the bit body 312, such that the active element 328 does not contact the formation, when in the retracted state. When actuated, the active element 328 is urged toward the extended state. The active element 328 may be actuatable to a plurality of positions between the retracted state and the extended state. When actuated, the active element 328 may apply a force to the formation (which also includes taking an increased proportion of the WOB), thereby altering the weight on the cutting structure, the DOC, or both. The force applied to the formation may lessen, cease, or prevent stick-slip behavior, vibration, whirl, motor stall, and other undesired effects.

In some embodiments, the active element 328 is biased toward or into the face or body of the bit 310. For example, a biasing element 330, such as a spring, a compressible fluid, a magnet, or other mechanism to apply a force to the active element 328 may be positioned in the bit 310 to bias the active element 328 away from the formation and the downhole end of the bit 310 having cutting elements 318. In the illustrated embodiment, this includes biasing the active element 328 in an uphole longitudinal direction that is coaxial with or parallel to the longitudinal axis 314. In other examples, the biasing element 330 may be positioned elsewhere in the BHA (e.g., in the drill collar), may bias the active element 328 at an angle relative to the longitudinal axis 314 of the cutting tool, or have other positions or orientations. The active element 328 may be selectively actuated or activated to move the active element 328 relative to the bit body 312 (e.g., in a downhole longitudinal direction). Actuation of the active element 328 may cause the active element 328 to protrude from the face, blade, or body of the bit 310, or to increase the amount of the active element 328 protrudes from the bit 310 if already beyond the face, blade, or body of the bit 310. By increasing the amount the active element protrudes 328, the active element 328 applies a force (or increased force) to the formation. An actuator controls the movement of the active element 328.

In some embodiments, the active element 328 is moved relative to the bit 310 by hydraulic pressure from a hydraulic fluid 332. The actuator of the active element 328 includes a valve 334 that at least partially controls the hydraulic pressure of the hydraulic fluid 332 from a fluid conduit 336 to a surface of the active element 328 (or a drive element coupled to the active element 328). In some embodiments, the hydraulic fluid 332 is a drilling fluid, and the fluid conduit 336 is a conduit from a surface drilling station that provides drilling fluid to the bit 310 and to the downhole environment. For instance, the fluid conduit 336 can include drill pipe or coiled tubing forming a drill string (e.g., drill string 105 of FIG. 1). In other embodiments, and as described in greater detail with respect to FIG. 4, the hydraulic fluid is a fluid that is isolated from the drilling fluid (e.g., a clean fluid).

In some embodiments, the valve 334 is a digital or on-off valve, allowing the hydraulic fluid 332 to flow in an open state and preventing flow of the hydraulic fluid 332 in a closed state. For example, the valve 334 may be moved to an open state and held open (or moved to a closed state and held closed) until the active element 328 is moved to the intended position. In other examples, the valve 334 is moved between the open state and the closed state repeatedly to actuate the active element 328 more than once in series and thereby move the active element to the intended position. In other embodiments, the valve 334 is a proportional valve that allow the valve to be moved to any of various discrete or proportional states between an open state and a closed state. With a proportional valve, the amount of hydraulic fluid 332 that creates a force to move the active element 328 may be varied (and have a proportion of the total flow and actuating force in the open state), thereby allowing the active element 328 to have multiple extended states.

The movement of the active element 328 can be controlled by a central processing unit (CPU) 338 or other processor(s) in data communication with valve 334 or other actuator, such as a hydraulic pump, an electric motor, or other devices for moving the active element 328. In some embodiments, the CPU 338 is in data communication with one or more sensors 340 that measure one or more downhole parameters and provide information regarding the downhole parameters to the CPU 338. The CPU 338 controls the movement and/or position of the active element 328 based, at least partially, upon the information received from the one or more sensors 340.

In some embodiments, at least one of the sensors 340 is positioned uphole from the bit 310. For example, a sensor 340 may be positioned uphole from the bit 310 to measure WOB. In other embodiments, at least one of the sensors 340 is positioned inside the bit 310. For example, a sensor 340 may be positioned in the bit body 312 to measure the rotational speed of the bit 310. In yet other embodiments, at least one of the sensors 340 is positioned downhole of a downhole motor. In further embodiments, at least one of the sensors 340 is positioned uphole from a downhole motor. For example, a pair of sensors 340 may be positioned on either longitudinal end (e.g., on an uphole side and on a downhole side of the bit) of a downhole motor to measure torque of the downhole motor, pressure differential across the downhole motor, rotational speed of the downhole motor, or combinations thereof.

In some embodiments, at least one sensor 340 is a formation sensor. A formation sensor is configured to measure one or more formation properties, including formation hardness, formation homogeneity (in the case of stratified formations), formation porosity, formation integrity, formation temperature, formation fluid content, formation fluid pressure, or other properties of the formation. In other embodiments, at least one sensor 340 is a drilling system sensor. A drilling system sensor is configured to measure one or more drilling system or BHA properties, including rotational speed, torque, vibration, linear speed, temperature, drilling fluid pressure, hydraulic fluid pressure, or other properties of the drilling equipment. For example, the sensor may be a force sensor, a torque sensor, a pressure sensor, a linear speed sensor, a rotational speed sensor, or other types of sensors to measure to movement of or forces applied to the drilling system.

The CPU 338 may further include, or be in data communication with a hardware storage device 342 that has instructions stored thereon. The instructions may be in the form of software or firmware code that, when executed by the CPU 338, cause the CPU 338 and/or the bit 310 to extend or retract the active element 328, or to perform any method or portion of a method described herein. The hardware storage device 342 may include a platen-based storage device, a solid-state storage device, RAM, or other persistent, non-transmission type, or long-term storage device.

Figure 4:
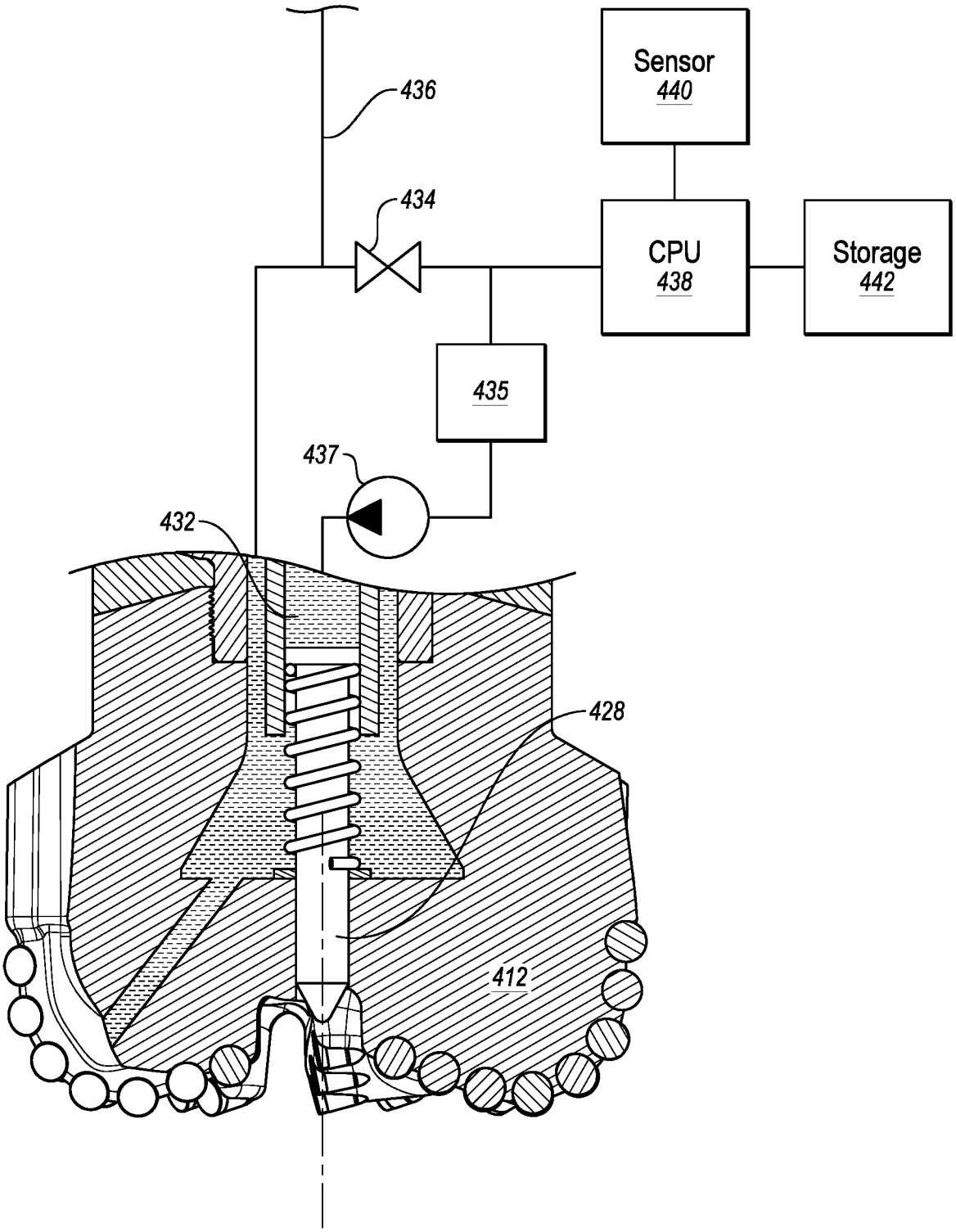
FIG. 4 is a cross-sectional view of another bit, according to at least one embodiment of the present disclosure.

Referring now to FIG. 4, in other embodiments, the hydraulic fluid 432 is a clean hydraulic fluid (e.g., not the drilling fluid provided from surface or which exits through nozzles of the bit). The hydraulic fluid 432 may be dedicated to the pressurization of the active element 428. For example, the fluid conduit 436 pressurizes a reservoir 435 and the valve 434 controls flow from the fluid conduit 436 to the reservoir 435. In some embodiments, the valve 434 is controlled by a CPU 438 in communication with one or more sensors 440 and a hardware storage device 442. When the valve 434 is closed, the valve restricts and potentially prevents fluid from the fluid conduit 436 increasing the pressure on the reservoir 435. When the valve 434 is open, the valve 434 allows fluid pressure from the fluid conduit 436 to pressurize the reservoir 435 and the hydraulic fluid 432 that, in turn, applies a force to the active element 428.

In some embodiments, a pump 437 provides pressurization or additional pressurization to the hydraulic fluid 432 from the reservoir 435 toward the active element 428 to move the active element 428 relative to the bit body 412. For example, the pump 437 may be a single-action piston pump, a double-action piston pump, a rotary pump, a progressive displacement cavity pump, or other fluid pump. In other embodiments, the active element 428 is moveable by one or more electric motors, such as a servo motor, a stepper motor, a linear actuator, a worm gear, an electromagnet, or other electronically controlled device to move the active element 428.

The sensors 340, 440 of FIGS. 3 and 4 may measure or sample downhole parameters with a sampling rate sufficient to allow the active elements 328, 428 to respond to changes in the downhole parameters. In some embodiments, the active element 328, 428 responds in real-time or in near real-time to changes to the downhole parameters. In some embodiments, the sampling rate is in a range having a lower value, an upper value, or lower and upper values including any of 10 Hz, 20 Hz, 50 Hz, 100 Hz, 250 Hz, 500 Hz, 1,000 Hz, 5,000 Hz, 10,000 Hz; or any values therebetween. For example, the sampling rate may be greater than 10 Hz. In other examples, the sampling rate is less than 10,000 Hz. In yet other examples, the sampling rate is between 10 Hz and 10,000 Hz. In further examples, the sampling rate is between 20 Hz and 5,000 Hz, between 50 Hz and 1,000 Hz, or is about 100 Hz. In still other examples, the sampling rate is less than 10 Hz or greater than 10,000 Hz.

Figures 1, 5:
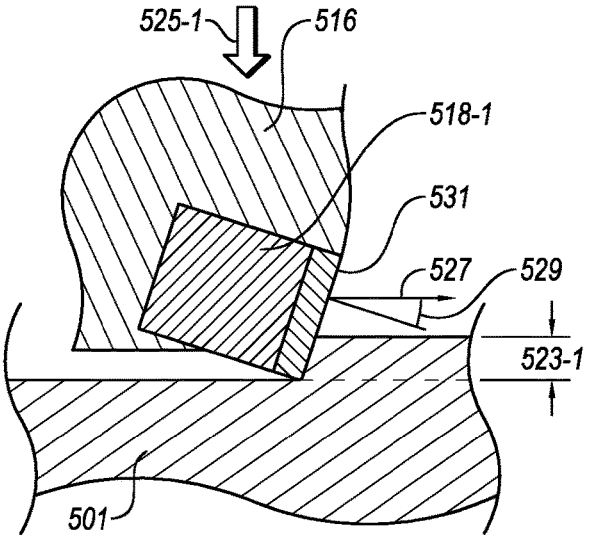
Figures 2, 5:
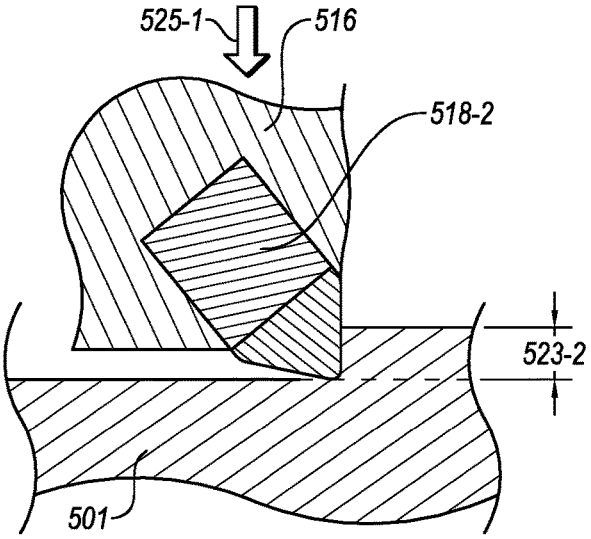
Figures 3, 5:
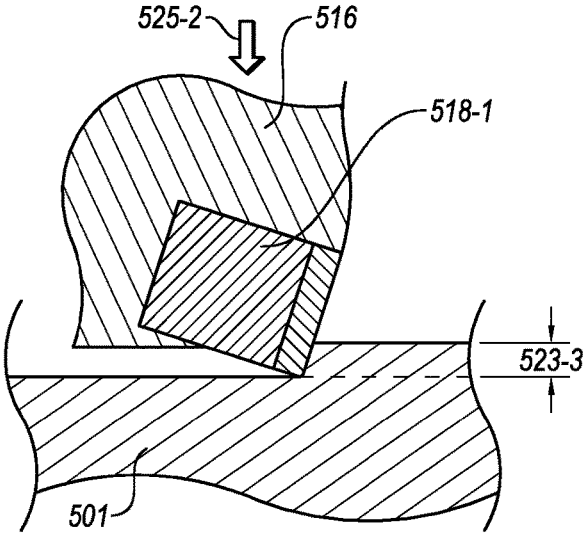

FIGS. 5-1 to 5-3 illustrate how DOC can change with cutting element geometry and WOB (or weight on cutting structure). FIG. 5-1 is a side cross-sectional detail of cutting element support 516 (e.g., a blade or roller cone) with a first cutting element 518-1 engaged with a formation 501 with a first DOC 523-1. Where there are multiple cutting elements, the total weight on the cutting structure may be distributed to some or each of the individual cutting elements. The portion of the total weight on the cutting structure applied to the cutting element 516 is shown as a first weight on cutting element 525-1. The first cutting element 518-1 is a shear cutting element, and the cutting element support 516 moves in a cutting direction 527 relative to the formation 501 (e.g., rotates such that the cutting face of the cutting element 518-1 rotationally leads the trailing end of the cutting element 518-1). The first cutting element 518-1 is oriented at a back rake angle 529 (negative back rake angle in FIG. 5-1) relative to the cutting direction 527. Increasing the rake angle 529 decreases the aggressiveness of the cutting element 518-1 and under the same loading conditions, also reduces the DOC. For example, a cutting element 518-1 with a back rake angle 529 of −10° has a face 531 that is 10° from perpendicular to the formation 501, and which is less aggressive and has a lower DOC than a cutting element 518-1 under the same loading conditions, that has a rake angle 529 of −5°, such that the face 531 that is 5° from perpendicular to the formation 501. The cutting element with the lower negative back rake angle 529 can therefore, under the same loading conditions, removes more material from the formation 501 than a cutting element with a higher negative back rake angle 529.

The discussion related to FIG. 5-1 assumes the face 531 is planar; however, the face 531 may have other shapes. For instance, a face of a cutting element 531 may be concave at the cutting tip engaging the formation 501. Where the cutting element 531 is concave at the cutting tip, the cutting element can have an effective back rake angle that is measured based on the face geometry, rather than the axis of the cutting element. Such a cutting element may have a positive effective back rake angle, despite the cutting element (as measured by the axis) having a negative back rake angle. A positive effective back rake angle may allow for even greater aggressiveness and depth of cut under equivalent loading conditions.

FIG. 5-2 illustrates the cutting element support 516 in cross-section with the first weight on cutting element 525-1. The cutting element support 516 supports a second cutting element 518-2 with a different cutting element geometry than the first cutting element 518-1 illustrated in FIG. 5-1. For example, the second cutting element 518-2 represents a conical, ridged, or other apexed cutting element. The apexed second cutting element 518-2 can apply a greater pressure to the formation 501 with the same weight on cutting element 525-1 as compared to the shear first cutting element 518-1 of FIG. 5-1, on account of greater point loading. The increased pressure may result in an increased second DOC 523-2 relative to the first DOC 523-1.

FIG. 5-3 is a side cross-sectional view of the first cutting element 518-1 with a second weight on cutting element 525-2. The second weight on cutting element 525-2 is less than the first weight on cutting element 525-1. The reduced second weight on cutting element 525-2 may result in a third DOC 523-3 that is smaller than the first DOC 523-1 illustrated in FIG. 5-1 when the first cutting element 518-1 and formation 501 are the same. While FIG. 5-1 through 5-3 illustrate changing the DOC by altering the cutting element geometry and the weight on the cutting element (or the weight on the total cutting structure), the DOC may be affected by other factors associated with the BHA or bit, or controlled by the drill operator. Examples include WOB, cutting element back and side rake angles, cutting element density, cutting element type, blade density, other drilling system properties, changes in the formation composition, porosity, fluid pressure, temperature, stratification, or other formation or environmental conditions.

Figure 6:
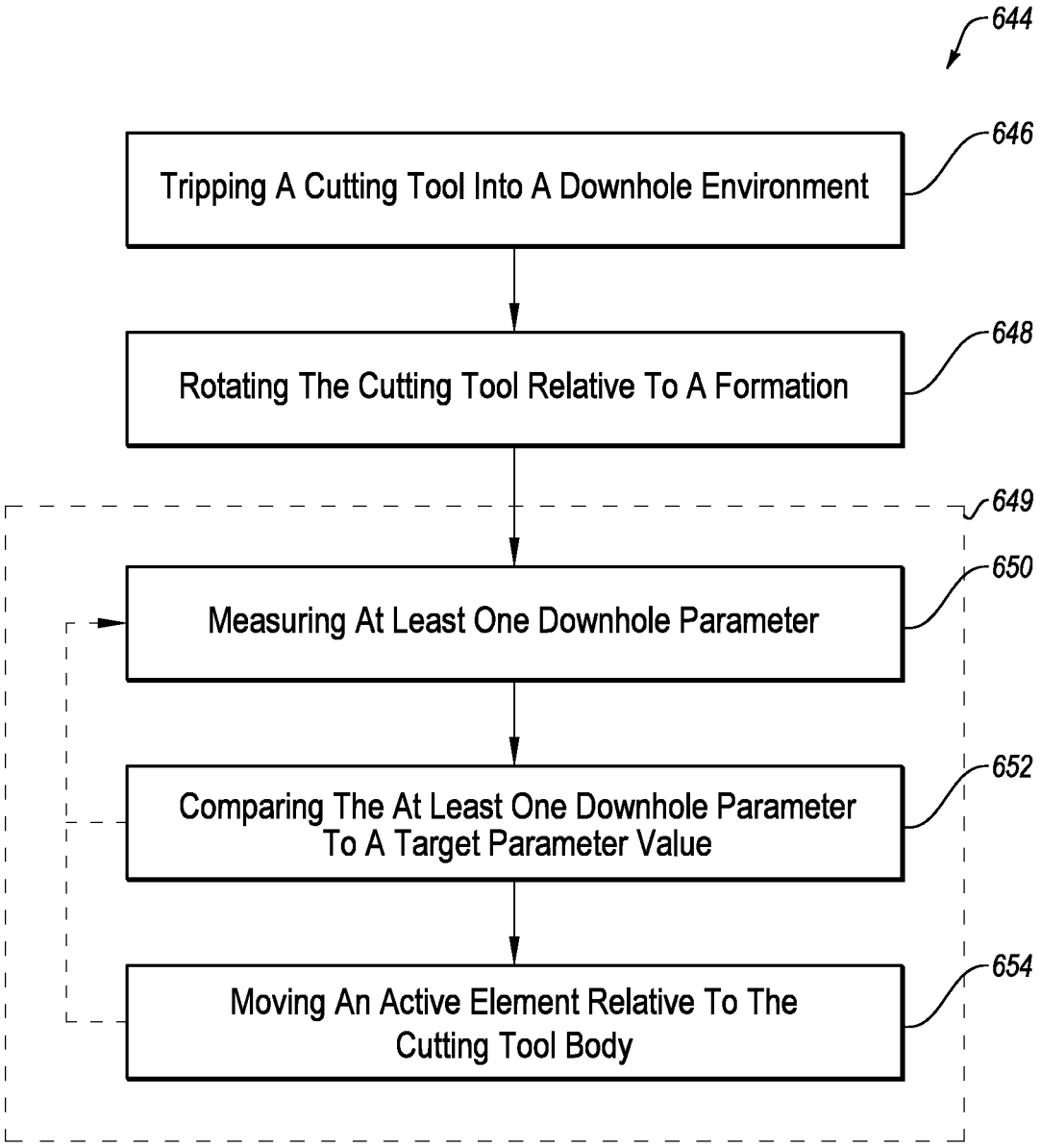
FIG. 6 is a flowchart illustrating a method of controlling a bit in a downhole environment, according to at least one embodiment of the present disclosure.

FIG. 6 is a flowchart illustrating an example method 644 of controlling a downhole cutting tool in a downhole environment. In the illustrated embodiment, the method 644 includes tripping a cutting tool into a downhole environment at 646. Tripping the cutting tool into the downhole environment at 646 can further include tripping a BHA, a drill string, or one or more downhole tools into the downhole environment. The downhole environment can include a straight, deviated, or directional wellbore, or portions that are straight, deviated, or directional. The cutting tool inserted into the wellbore can include an active element that is moveable relative to the cutting tool body. In some embodiments, the active element is movable in at least a longitudinal direction and, as a result, the amount the active element protrudes from a face or body of the cutting tool selectively varies. The method 644 includes rotating the cutting tool at 648. In some embodiments, the bit is rotated by a top drive or rotary table and the torque to rotate the cutting tool is transmitted through the drill string from the top drive to the cutting tool. In other embodiments, the cutting tool is rotated by a downhole motor (e.g., a mud motor or turbodrill) driven by a drilling fluid and positioned in the drill string within the downhole environment. Rotating the cutting tool at 648 can also include applying weight to the cutting tool. For instance, the drill string and BHA may contribute to weight applied to the cutting tool, or a downhole tractor or other component may apply weight to the cutting tool.

The method 644 of FIG. 6 further includes controlling the movement of an active element of the cutting element at 649. In FIG. 6, controlling the movement of an active element 649 is accomplished by, at least in part, measuring at least one downhole parameter at 650, comparing the at least one downhole parameter to a target parameter value at 652, and moving the active element relative to the cutting tool body at 654. In some embodiments, measuring at least one downhole parameter includes using at least one sensor (e.g., sensor(s) 240-1, 240-2, 240-3 of FIG. 2 or sensor(s) 340, 440 of FIGS. 3 and 4) in communication with a processor (such as CPU 338 or 438 of FIGS. 3 and 4). The downhole parameter may be a property of the surrounding formation around the cutting tool. For example, the downhole parameter may include formation property, including formation hardness, formation homogeneity (in the case of stratified formations), formation porosity, formation integrity, formation temperature, formation fluid content, formation fluid pressure, or other properties of the formation.

Controlling the movement of the active element at 649 optionally includes periodically, continuously, or iteratively repeating at least a portion of measuring at least one downhole parameter at 650, comparing the at least one downhole parameter to a target parameter value at 652, or moving the active element relative to the cutting tool body at 654. For example, after or while moving an active element relative to the bit body at 654, the system may measure the at least one downhole parameter again, compare the measured at least one downhole parameter to the target parameter value, and then not move the cutting element relative to the tool body (e.g., when there is not sufficient difference between the measured and target parameters). In other examples, after comparing the at least one downhole parameter to a target parameter value at 652, the system may measure the at least one downhole parameter again when it is determined the active element should not be moved relative to the cutting tool body.

The downhole parameter measured using at least one sensor at 650 may also or instead be a property of the cutting tool, BHA, or drill string. For example, the downhole parameter may be the rotational speed of a cutting tool or BHA, WOB, ROP, lateral vibration of the cutting tool, axial vibration of the cutting tool, other accelerometer readings from the cutting tool or BHA, the torque on the cutting tool, torque above the cutting tool, torque on a downhole motor rotor or shaft, DOC of one or more cutting elements, pressure drop of the drilling fluid across a cutting tool or downhole motor, or other properties of the cutting tool, BHA, or drill string. In other examples, the downhole parameter includes a relative value, such as a measured difference in rotational rate between the surface drive system (e.g., top drive or rotary table) and the cutting tool/BHA, a difference in rotational rate between the cutting tool and the downhole motor drive shaft, or a difference in torque between the cutting tool and the surface drive system.

In some embodiments, comparing the at least one downhole parameter to a target parameter value at 652 includes calculating a difference between the at least one downhole parameter and the target parameter. For example, the processor receives measured downhole parameter(s) from the sensor(s) and compare the value of a measured downhole parameter to a target parameter. The target parameter is optionally a dynamically calculated target value, and comparing the downhole parameter to a target parameter at 652 can include calculating the difference therebetween. In some examples, the target parameter is a constant value. For example, the drill operator may set the target rotational speed of the bit (e.g., at 120 revolutions per minute (RPM)) and some or all deviations from the target result may in movement of the active element at 654.

In other examples, the target parameter is dynamically calculated. An example, dynamically calculated target parameter is a rolling average of the rotational speed of the cutting tool. For example, the target parameter may be a 30-second rolling average of the measured rotational speed of the cutting tool. Sudden deviations from the 30-second rolling average—either instantaneous or other rolling averages—can result in movement of the active element at 654.

In some examples, the relative rotational rate of the cutting tool to the rate of the torque source (e.g., top drive, rotary table, mud motor, or turbodrill) may indicate the presence of stick-slip behavior. The target parameter may be a rate of rotation of the torque source, and the measured downhole parameter may be the rate of rotation of the cutting tool. If a measured downhole parameter does not exceed the target parameter value, the method 644 may include returning to measuring the downhole parameter. In contrast, and by way of example, if a drilling system detects the parameter exceeds the target parameter value or deviates a significant amount from the target parameter (e.g., at least 5%, 10%, or 15% deviation between the rate of rotation of a top drive or mud motor and the cutting tool at 652), the active element may be moved at 654. In another example, if a 10% deviation of the rate of rotation of the cutting tool from the rate of rotation of a torque source is detected at 652, the system may trigger a proportional opening or closing of a valve (e.g., valve 334, 434 of FIGS. 3 and 4) to change a hydraulic pressure to the active element and move the active element a corresponding amount. By moving the active element, the active element may reduce the DOC and/or the portion of WOB on the cutting structure, and allow the bit to increase in speed. For example, reducing the DOC reduces the drag of the bit and allows the bit to more efficiently transfer torque and regain speed. The increase in speed may allow any torsional energy in the drill string to dissipate, avoiding the sudden step changes in the bit rate of rotation that are experienced during the slipping portion of stick-slip behavior.

In some embodiments, a combination of different measured downhole parameters and associated target parameters may be used to control the active element at 654. For example, a measured deviation from a first target parameter (e.g., 10% pressure drop across the downhole motor) in combination with a measured deviation from a second target parameter (e.g., 10% difference in bit rotational speed) results in a more aggressive actuation of the active element than either the measured 10% deviation from a first target parameter or the measured 10% deviation from a second target parameter, individually.

The movement of the active element relative to the cutting tool body at 654 can include moving the active element away from the cutting tool body or into the cutting tool body. The movement of the active element away from the cutting tool body and toward a formation can apply a force or increase a force applied by the active element to the formation. The application of force or increased application of force by the active element may increase the portion of the WOB supported by the active element and reduce the portion of the WOB that is applied to the other cutting structure as a whole, and the portion applied to individual cutting elements. The movement of the active element into the cutting tool body and away from a formation can remove an applied force or decrease the force applied to the formation. The reduced application of force by the active element can reduce the portion of the WOB supported by the active element and increase the portion of the WOB that is applied to the cutting elements and cutting structure.

In some embodiments, moving the active element relative to the bit body at 654 includes moving a valve between at least one open state and a closed state to change a hydraulic pressure applied to the active element. For example, opening the valve (or further opening the valve) allows flow of the hydraulic fluid and/or increases the hydraulic pressure of the hydraulic fluid to move the active element away from the cutting tool body and toward the formation. In other examples, closing the valve restricts and potentially prevents flow of the hydraulic fluid, or reduces the hydraulic pressure of the hydraulic fluid used to move the active element into or toward the cutting tool body and away from the formation.

Figure 7:
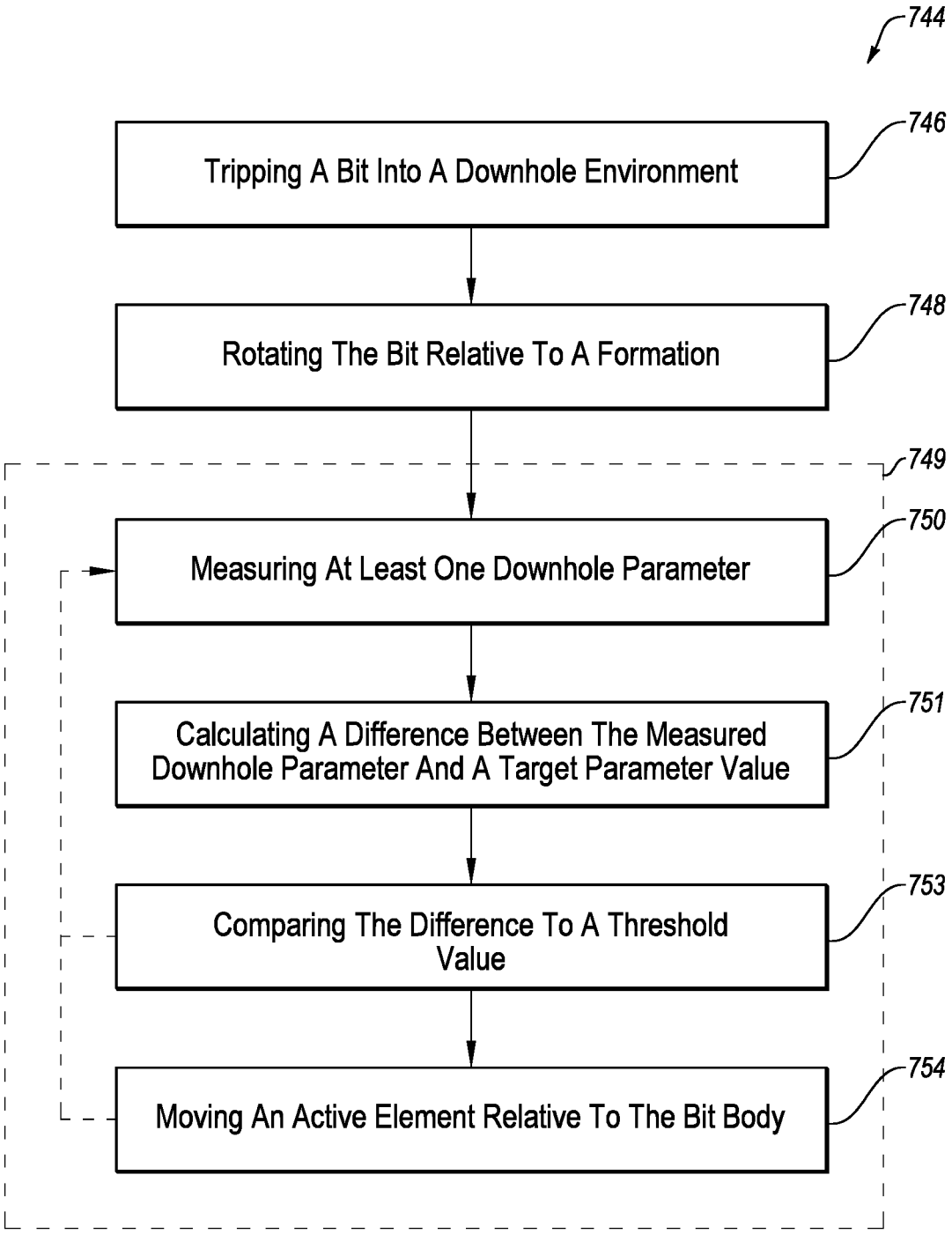
FIG. 7 is a flowchart illustrating another method of controlling a bit in a downhole environment, according to at least one embodiment of the present disclosure.

In other embodiments, moving the active element relative to the cutting tool body at 654 includes actuating a fluid pump to change a hydraulic pressure applied to the active element. For example, the pump may be a single-action piston pump, a double-action piston pump, a rotary pump, a progressive displacement cavity pump, or other fluid pump. In yet other embodiments, the active element is moveable by one or more electric motors, such as a servo motor, a stepper motor, a linear actuator, a worm gear, an electromagnet, or other electronically controlled device to move the active element. In still other embodiments, moving the active element relative to the FIG. 7 illustrates another embodiment of a method 744 of controlling a cutting tool in a downhole environment. Although the method 744 is described in the context of a bit, the method applies equally for other types of cutting tools.

In the illustrated embodiment, the method 744 includes tripping a bit into a downhole environment at 746, and rotating the bit relative to the formation at 748. Tripping the bit into the downhole environment and rotating the bit relative to the formation can be similar to, or the same as, the similar elements 646 and 648 of FIG. 6.

The method 744 of FIG. 7 further includes controlling the movement of an active element of the bit at 749. Controlling the movement of an active element includes measuring at least one downhole parameter at 750, calculating a difference between the measured downhole parameter and a target parameter value at 751, comparing the difference to an actuation threshold value at 753, and moving an active element relative to the bit body at 754. In some embodiments, measuring at least one downhole parameter includes using at least one sensor (such as the sensor(s) 240-1, 240-2, 240-3, 340, and 440 of FIGS. 2-4) in communication with a processor (such as CPU 338 or 438 of FIGS. 3 and 4). The downhole parameter may be a property of the surrounding formation around the bit or a property of the bit or drill string, as described in relation to FIG. 6.

In some embodiments, calculating a difference between the measured downhole parameter and a target parameter value at 751 and comparing the difference to an actuation threshold value at 753 is used to determine if and when to move the active element at 754. For the method 744 may be used to open a valve and/or actuate a pump to apply a hydraulic pressure to the active element and thereby move the active element when the measured downhole parameter exceeds or drops below the threshold value, or when the difference between the measured downhole parameter and the target parameter exceeds a threshold value. In contrast, there may be no response when the measured parameter is within a desired range, or when the difference does not exceed a threshold. For example, if the actuation threshold value is a 10% deviation from the target parameter, the active element is actuated when the difference between the measured downhole parameter and the target parameter value is calculated to be greater than 10% of the target parameter value.

In some embodiments, the target parameter value is a constant or fixed value from which the actuation threshold value is based. For example, the target parameter value may be a bit rotational speed (e.g., 200 RPM) while the actuation threshold value is a percent deviation from the rotational speed (e.g., 10% of the target parameter, or 20 RPM), which can create a target range (e.g., 180 to 220 RPM). A measured bit rotational speed that is outside the desired range (e.g., greater than 220 RPM or less than 180 RPM) can therefore results in a difference between the between the measured downhole parameter and a target parameter value of greater than the 10% actuation threshold value. In other examples, the target parameter value may be a torque on the bit. In such an example, with the actuation threshold value at 15%, a bit torque that is directly measured or is indirectly calculated and which is 15% above or 15% below the target bit torque results in actuation of the active element. The target torque parameter value of the bit may be in a range having a lower value, an upper value, or lower and upper values including any of 5.0 kilopound-feet (klbf-ft) (6.8 kN-m), 7.5 klbf-ft (10.2 kN-m), 10.0 klbf-ft (13.6 kN-m), 12.5 klbf-ft (16.9 kN-m), 15.0 klbf-ft (20.3 kN-m), 17.5 klbf-ft (23.7 kN-m), 20.0 klbf-ft (27.1 kN-m), 22.5 klbf-ft (30.5 kN-m), 25.0 klbf-ft (33.9 kN-m), 30.0 klbf-ft (40.7 kN-m), 35.0 klbf-ft (47.5 kN-m), 40.0 klbf-ft (54.2 kN-m), or any values therebetween. For example, the target torque parameter value on the bit may be greater than 5.0 klbf-ft (6.8 kN-m). In other examples, the target torque parameter value on the bit may be less than 25.0 klbf-ft (33.9 kN-m) or less than 40.0 klbf-ft (54.2 kN-m). In yet other examples, the target torque parameter value on the bit may be between 5.0 klbf-ft (6.8 kN-m) and 25.0 klbf-ft (kN-m), or between 5.0 klbf-ft (6.8 kN-m) and 40.0 klbf-ft (54.2 kN-m). In yet other examples, the target torque parameter value on the bit may be less than 5.0 klbf-ft (6.8 kN-m) or greater than 40.0 klbf-ft (54.2 kN-m).

In other embodiments, the target parameter value is determined as a historical value of the downhole parameter. For example, the target parameter value may be a cumulative average, median value, or a rolling average of a downhole parameter from which the actuation threshold value is based. In at least one example, the target parameter value may be a 15-second, 30-second, 60-second, 90-second, or 120-second (or other duration) rolling average. As an example, the target parameter value may be a pressure differential across a downhole motor, although any suitable parameter value as discussed herein may be used. If the actuation threshold value is a 15% deviation from the target parameter value, when a measured pressure differential across the downhole motor deviates from the rolling average of the pressure differential across the downhole motor by an amount greater than 15% of the rolling average, the active element may be moved relative to the bit body. In other examples, the target parameter value may be a 20-second (or other duration) rolling average of a bit rotational speed, with an actuation threshold value that is 5%, 10%, 20%, or another percentage of the rolling average. In some examples, the measured value of the downhole parameter is an instantaneous value; however, in other examples, the measured value is an average (e.g., a rolling average) of a duration that is shorter than the target parameter rolling average. Accordingly, within the present disclosure, the measured value of a downhole parameter includes not only the raw data or measurement, but values calculated or derived from the raw data (e.g., an average, a difference relative to another value, etc.). As an illustration, if the target parameter is 20-second rolling average, the difference between the measured downhole parameter and the target parameter value may be calculated using a measured downhole parameter that is a 3-second or 5-second rolling average of the instantaneous measurements of the downhole parameter. In at least one example, when the shorter rolling average of the bit rotational speed deviates by more than 5%, 10%, 15%, 20% (or some other percentage) of the longer rolling average of the bit rotational speed, pressure differential, torque, or the like, the active element is actuated.

In at least one example, the torque on the bit while drilling may remain approximately constant when drilling through a homogeneous formation at a constant WOB. The intended torque value may be the target parameter and the measured torque may be the measured downhole parameter. If the torque on the bit increases above an actuation threshold value (e.g., a specific value or a value based on the difference from a value), or drops below an actuation threshold value, the active element may move in a downhole or other direction that will apply a force to the formation (supporting a portion of the WOB) and decrease the weight on other components (e.g., the cutting structure), thereby limiting or even preventing the torque on the bit (from the formation) from overcoming the torque provided by a downhole motor, which may cause the motor to stall.

In some embodiments, comparing the at least one downhole parameter to a target parameter includes comparing the at least one downhole parameter to a plurality of threshold values of that downhole parameter. For example, a first threshold value and a second threshold value may each be associated with a first amount of movement and/or force of the active element and a second amount of movement and/or force of the active element, respectively. Thus, if the measured or calculated value exceeds the first threshold, the active element may be moved a first amount (or a first amount of force may be applied), but if the measured or calculated value exceeds both the first and second thresholds, the active element may be moved a second amount (or a second amount of force may be applied).

In some embodiments, the first and second threshold values are nominal values set by a drill operator or by a manufacturer or servicer of the drilling tool. For example, a first threshold may be a rotational speed of the bit that is 90 RPM, and the second threshold may be a rotational speed of the bit that is 80 RPM. In other examples, the first and second threshold values may relate to rolling averages calculated over different time periods. For example, the first threshold value may be when the 30-second rolling average of the bit rotational speed or torque is below 80% of the torque source rotational speed or torque, while the second threshold value may be when a 0.5-second rolling average falls below 60% of the torque source rotational speed or torque. Exceeding the first threshold may prompt a lesser force applied by the active element to the formation or a shorter duration of actuation to allow the bit to speed up and match the torque source, while exceeding the second threshold may indicate a more severe change in downhole behavior and prompt a more aggressive intervention with the active element in terms of extent or duration, to limit or prevent motor stall or stick-slip.

In another example, the measured value or difference in measured values of a plurality of different downhole parameters may be used to determine when to actuate the active element. For example, a first threshold may be associated with a measured torque applied to the bit, and a second threshold may be associated with a bit rotational speed. The measured torque applied to the bit may be within the first threshold, and the measured bit rotational speed may be within the second threshold, but a composite deviation of the measured torque from the target torque value and the deviation of the measured bit rotational speed from a target bit rotational speed may cause the active element to be actuated.

In a particular example, a 20% total deviation from the target parameter values may cause the active element to be actuated. Different combinations of measured downhole parameter can result in a 20% total deviation and an actuated active element. For example, a 10% deviation of a first downhole parameter combined with a 10% deviation of a second downhole parameter may cause the active element to be actuated. In another example, a 15% deviation of a first downhole parameter combined with a 5% deviation of a second downhole parameter may cause the active element to be actuated. In yet another example, a 20% deviation of a first downhole parameter combined with a 0% deviation of a second downhole parameter may cause the active element to be actuated. In a further example, a 2% deviation of a first downhole parameter combined with a 18% deviation of a second downhole parameter may cause the active element to be actuated. As will be appreciated in view of the disclosure herein, more than two parameters may also be measured and compared to determine a total deviation used to trigger actuation of an active element.

In some embodiments, the active element may be actuated when a total deviation of measured downhole parameters exceeds an actuation threshold value. For example, the active element may be actuated when the total deviation of the measured downhole parameters exceeds 100% deviation relative to threshold values for each downhole parameter. In at least one example, a torque applied to the bit may have a 20% threshold value. Additionally, the rotational speed of a downhole motor may have a 10% actuation threshold value.

If, for example, the measured torque on the bit deviates from the target parameter value by 50% of the actuation threshold value (e.g., a measured torque that is a 10% deviation, while the actuation threshold value is a 20% change in torque) and the rotational speed of the downhole motor deviates from the target parameter value by 50% of the actuation threshold value (e.g., a measured rotational speed that is a 5% deviation, while the actuation threshold is a 10% chance in rotational speed), the active element may be actuated as the total deviation is 100% (i.e., 50% deviation in torque+50% deviation in rotational speed). In other embodiments, the active element is actuated by simultaneously comparing three or more measured downhole parameters against target parameter values and/or threshold values, such as the relative rate of rotation of the bit to the torque source, the torque on the bit, the pressure drop across the bit, the formation hardness, the change in formation hardness, the formation porosity, the formation fluid pressure, the drilling fluid temperature, or other downhole parameters. In at least some embodiments, a CPU or other processor(s) may use artificial intelligence or machine learning to review historical data on a run and anticipate when stick-slip behavior or motor stall may occur. For instance, multiple data points related to downhole parameters, vibration, whirl, fluid flow, cuttings transport, and the like may be evaluated and information from those learnings may establish dynamic thresholds that predict future stick-slip behavior and motor stall for activation of the active element.

In some embodiments, calculating a difference between the measured downhole parameter and the target parameter and comparing the measured downhole parameter to a threshold value further includes also comparing the at least one downhole parameter to a target parameter. For example, a 10% deviation of the torque applied to the bit relative to the target parameter value for the desired torque may prompt a movement of the active element to begin moving the active element. In another example, calculating a difference between the measured downhole parameter and the target parameter may include comparing the measured downhole parameter to multiple threshold values. For instance, multiple threshold values may include deviations of 10% of torque applied to a bit and 50% of torque applied to the bit. If a downhole parameter is measured to be a 20% deviation of the torque applied to the bit relative to the target parameter value, an actuator may cause a movement of the active element to apply a first amount of the maximum force that the active element can apply (e.g., 20% of the maximum force). As an example, for an active element that can apply 10,000 pounds of force (lbf) (44.5 kN), the active element may apply 2,000 lbf (8.9 kN). However, if the torque applied to the bit exceeds a second threshold value (e.g., a deviation of 50% of the torque target parameter value), the active element may be actuated a different amount (e.g., 100% of the maximum force). As such, for the active element described above, the full force of 10,000 lbf (44.5 kN) may be applied to the active element to limit or prevent motor stall or stick-slip.

The method 744 further includes optionally moving the active element relative to the bit body at 754 similar to as described in relation to FIG. 6. The movement of the active element relative to the bit body can include moving the active element away from the bit body or into the bit body. The movement of the active element away from the bit body and toward a formation can apply a force or increase a force applied to the formation. The application of force or increased application of force by the active element may increase the portion of the WOB supported by the active element and reduce the portion of the WOB that is applied to the cutting elements or other portion of the cutting structure. The movement of the active element toward or into the bit body and away from a formation can remove an applied force or decrease the force applied to the formation. The reduced application of force by the active element can reduce the portion of the WOB supported by the active element and increase the portion of the WOB that is applied to the cutting structure.

In some embodiments, moving the active element relative to the bit body at 754 includes moving a valve between an open state and a closed state to change a hydraulic pressure applied to the active element. For example, opening the valve allows flow of the hydraulic fluid and/or increases the hydraulic pressure of the hydraulic fluid to move the active element away from the bit body and toward the formation. In other examples, closing the valve restricts and/or prevents flow of the hydraulic fluid and/or reduces the hydraulic pressure of the hydraulic fluid to move the active element into the bit body and away from the formation.

In other embodiments, moving the active element relative to the bit body at 754 includes actuating a fluid pump to change a hydraulic pressure applied to the active element. For example, the pump may be a single-action piston pump, a double-action piston pump, a rotary pump, a progressive displacement cavity pump, or other fluid pump. In yet other embodiments, the active element is moveable by one or more electric motors, such as a servo motor, a stepper motor, a linear actuator, a worm gear, an electromagnet, or other electronically controlled device to move the active element.

Additionally, and as discussed with respect to FIG. 6, controlling the movement of an active element of the bit at 749 can include continuous, iterative, or repeated measurement of the at least one downhole parameter at 750, calculation of the difference between the measured downhole parameter and the target parameter value at 751, comparing the difference to an actuation threshold value at 753, and movement of the active element at 754. Accordingly, if the comparison at 753 does not result in movement of the active element at 754, the method 744 may include again measuring the downhole parameter 750 and proceeding through the acts shown in and described relative to FIG. 7. Similarly, if the active element is moved at 754, the downhole parameter may again be measured at 750 and the difference calculated at 751. With sufficient difference determined when comparing at 753, the active element may continued to be held in the moved or active position at 754. In another example, comparing the difference to the threshold value at 753 may be a comparison to a deactivation threshold value, and with sufficient difference (or absent sufficient difference), movement of the active element relative to the bit body may be to retract the active element from an active position at 754.

Figure 8:
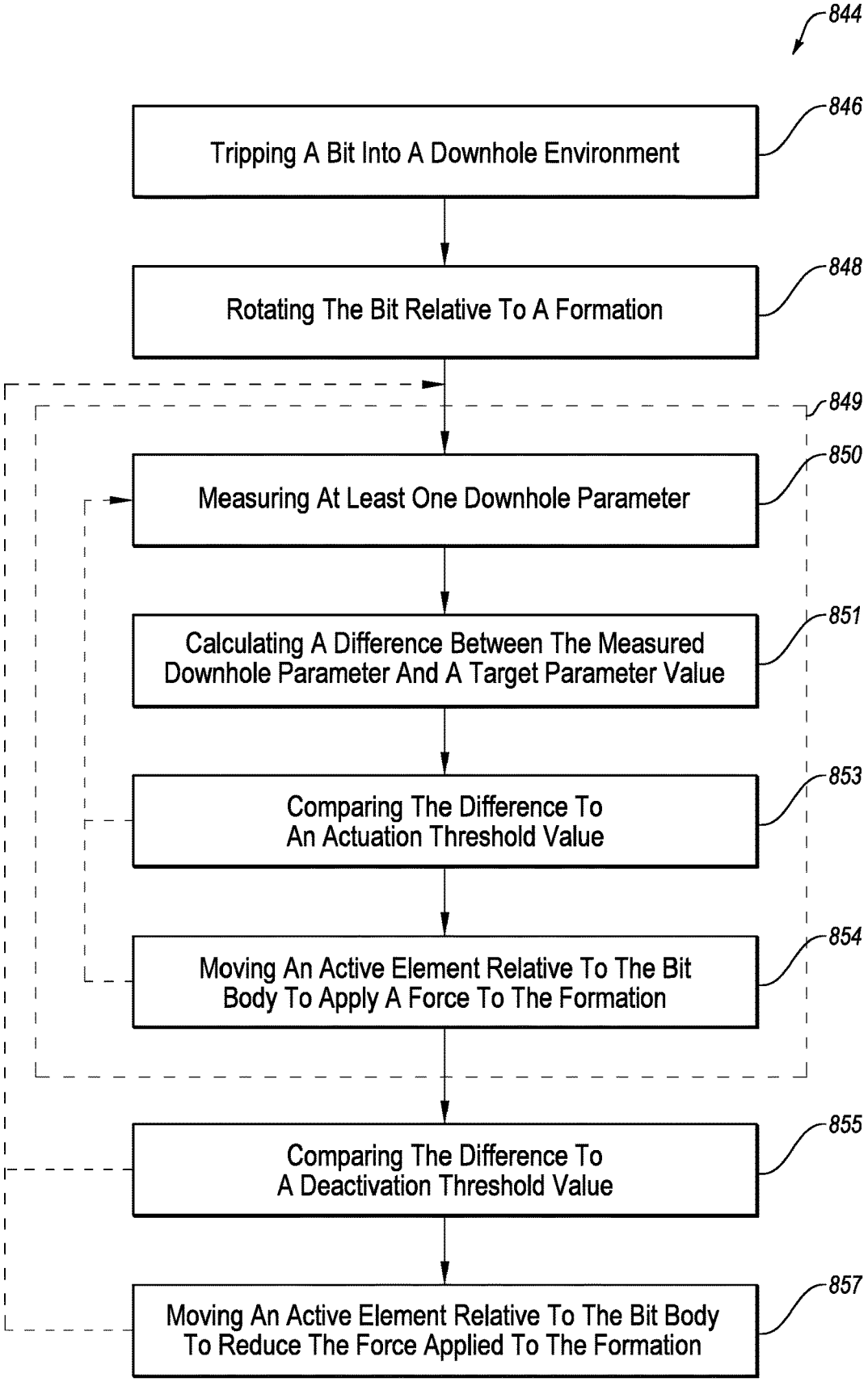
FIG. 8 is a flowchart illustrating yet another method of controlling a bit in a downhole environment, according to at least one embodiment of the present disclosure.

FIG. 8 is a flowchart illustrating another embodiment of a method 844 of controlling a cutting tool in a downhole environment. The cutting tool may include any suitable downhole cutting tool, including a bit, which is referenced for convenience in describing FIG. 8. In the illustrated embodiment, the method 844 includes tripping a bit into a downhole environment at 846, and rotating the bit relative to a formation at 848. These acts are similar to, or the same as, corresponding acts described relative to FIGS. 6 and 7.

The method 844 of FIG. 8 further includes controlling the movement of an active element of the bit at 849. Controlling the movement of an active element includes measuring at least one downhole parameter at 850, calculating a difference between the measured downhole parameter and a target parameter value at 851, comparing the difference to an actuation threshold value at 853, and moving an active element relative to the bit body to apply a force to the formation at 854, similarly to as described in relation to FIG. 7. In some embodiments, measuring at least one downhole parameter includes using at least one sensor (such as the sensor(s) 240-1, 240-2, 240-3, 340, 440, of FIGS. 2-4) in communication with a processor (such as CPU 338, 438 of FIGS. 3, 4). The downhole parameter may be a property of the surrounding formation around the bit or a property of the bit or drill string, as described in relation to FIGS. 6 and 7.

In some embodiments, the active element may be moved toward an extended state to apply a force to the formation for a fixed duration. For example, moving the active element at 854 includes moving the active element at an actuation rate and/or with an actuation duration. In some embodiments, the actuation rate is fixed, while in other embodiments the actuation rate varies depending on the measured downhole parameter, the amount of deviation from the target parameter, the amount by which the measured downhole parameter exceeds a threshold value, or combinations thereof. For example, the actuation rate may be greater when a measured downhole parameter is farther from the target parameter than when the measured downhole parameter is closer to the target parameter. As an example, the active element may move toward the extended state at a greater rate when the measured downhole parameter deviates from the target parameter by 50% than when the measured downhole parameter deviates from the target parameter by 20%. In other examples, the active element moves toward the extended state at a greater rate when a first measured downhole parameter deviates from a first target parameter by 20% than when a second measured downhole parameter deviates from a second target parameter by 20%. In yet other examples, the active element may move toward the extended state at a greater rate when the first measured downhole parameter exceeds a first threshold value than when the second measured downhole parameter exceeds a second threshold value that is the same, less than, or greater than the first threshold value.

In some embodiments, the actuation duration is fixed. For example, each instance of an active element actuating may have an actuation duration of 0.05 second, 0.1 second, 0.25 second, 0.5 second 1.0 second, 1.5 seconds, 2.0 seconds, 3.0 seconds, 5.0 seconds, 10 seconds, or other length actuation duration, or anything therebetween. In other embodiments, the actuation duration can vary depending on the measured downhole parameter, the amount of deviation from the target parameter, the amount by which the measured downhole parameter exceeds a threshold value, or combinations thereof. For example, the active element may be maintained in the extended state, or in another actuated state, for a greater duration when a first measured downhole parameter triggers the actuation of the active element than when a second measured downhole parameter triggers the actuation of the active element. The active element may remain actuated longer (e.g., protruding a maximum distance from the bit and/or applying a maximum force to the formation) when a pressure drop across the mud motor is measured to exceed a first threshold value than when a bit rotational speed is measured to exceed a second threshold value.

In another example, the active element is maintained in the extended state, or in another actuated state, for a greater duration when a measured downhole parameter is farther from the target parameter than when the measured downhole parameter is closer to the target parameter. For example, if a measured pressure drop across the mud motor changes by 80% in under 0.5 second, the active element may remain actuated for a longer duration than another actuation triggered by a second measured downhole parameter (such as change in formation fluid pressure). This may be because the high pressure drop may be considered to create an associated pressure wave in the drilling fluid that is likely to cause damage to the mud motor as the pressure wave moves through the fluid conduit, and the pressure wave may take more time to stabilize in the drilling fluid to limit or prevent damage to the mud motor.

In other embodiments, the active element may be moved toward the extended state and apply a force (reducing the proportion of weight on the other cutting structure) until one or more downhole parameters are measured to be within a deactivation threshold value. For example, the method 844 of FIG. 8 includes comparing the difference to a deactivation threshold value at 855 and moving the active element relative to the bit body to reduce the force applied to the formation by the active element at 857. After actuation, the active element may be retracted toward the retracted state upon alleviating the conditions that triggered the actuation or other conditions associated with the stick-slip behavior or motor stall.

In some embodiments, the active element is held in the actuated state and retracted upon the difference between the measured downhole parameter and the target parameter value being compared to a deactivation threshold value, and the difference being less than the deactivation threshold value. For example, when a measured downhole parameter exceeds an actuation threshold value, the active element may be actuated and remain in the actuated state until the measured downhole parameter changes and the difference is measured to be within the deactivation threshold value.

In some examples, the actuation threshold value and deactivation threshold value are the same. For example, if the measured downhole parameter is the bit rotational speed, the actuation threshold value may be a 20% change from a rolling average of bit rotational speed. The active element is actuated when the bit rotational speed is measured to be less than 80% of the rolling average. As shown in FIG. 8, even after moving the active element at 854, the method 844 includes continuing to measure the downhole parameter at 850, calculate the difference between the measured downhole parameter and the target parameter value at 851, and comparing the difference to the actuation threshold value at 853. If the calculated difference becomes less than the 20% threshold value (i.e., the target is more than 80% of the rolling average), the active element can be moved relative to the bit body at 857 and fully or partially retracted to reduce the force applied to the formation. In such an embodiment, the actuation threshold value may act as both an actuation and deactivation threshold value. Such operation also applies for the methods of FIGS. 6 and 7, where moving the active element relative to the bit body at 654, 754 can include either extending the active element in response to a measured parameter or calculated difference exceeding a target parameter value or threshold value, or retracting the active element in response to the measured parameter or calculated difference no longer exceeding the target parameter or threshold values. Additionally, in some embodiments, the active element is actuated when the bit rotational speed is measured to be greater than 120% of the rolling average, and the active element remains in the actuated state until the bit rotational speed is less than 120% of the rolling average.

In other examples, the actuation threshold value and deactivation threshold value are different such that the movement of the active element exhibits a hysteresis. For example, the measured downhole parameter may be the bit rotational speed, the actuation threshold value may be a 20% change from a rolling average of bit rotational speed, and the deactivation threshold value may be a 10% deviation from the rolling average of the bit rotational speed. In such an example, the active element is actuated when the bit rotational speed is measured to be less than 80% or greater than 120% of the rolling average (i.e., at least a 20% difference from the rolling average), and the active element remains in the actuated state until the bit rotational speed is restored to be greater than 90% or less than 110% of the rolling average.

In some embodiments, repeated actuations may, over time, cause damage to the active element and/or the hydraulic or other motive device that moves the active element. A hysteresis may, therefore, extend the operational lifetime of the active element by actuating the active element until the measured downhole parameter is closer to the target parameter value than the actuation threshold value. For example, when the actuation threshold value and the deactivation threshold value are the same, the measured downhole parameter may remain near the threshold value resulting in repeated and rapid actuations of the active element. In some embodiments, methods of the present disclosure may also include counting the number of activations within a given period. If the number of activations exceeds an activation count threshold, the actuation threshold value, the deactivation threshold value, the dynamic variables (e.g., rolling average length or measured value average length) may be adjusted to reduce the number of activations. In another embodiment, if the number of activations exceeds the activation count threshold, an actuator may be put into a sleep mode. For instance, a CPU may stop processing measurements for a specific period of time, until the tool is returned to surface, or until a signal is received to wake from the sleep mode. The activation count threshold may be any suitable value, but in some embodiments may include more than two activations per minute, more than three activations per minute, more than five activations per minute, more than ten activations per five minutes, or other values, or any values therebetween.

In some embodiments, the deactivation threshold may change as a function of the quantity of actuations over a period of time or over a distance of drilling. The deactivation threshold can become closer to the target parameter value, which can result in the active element remaining actuated until the measured downhole parameter is closer to the target parameter. In the previous example in which the actuation threshold value is a 20% change from a rolling average of bit rotational speed, and the deactivation threshold value is a 10% deviation from the rolling average of the bit rotational speed, that deactivation threshold may vary. For instance, when the active element is actuated more than, for example, four times in a minute, the deactivation threshold value may change to be 7.5% or 5% from the rolling average of the bit rotational speed. The active element will, therefore, remain actuated for a longer period of time until the bit rotational speed is measured within 7.5% or 5% of the rolling average of the bit rotational speed. Restoring the downhole parameter closer to the target parameter value allows the downhole parameter to be farther from the actuation threshold value and limits the number of needed actuations.

Additionally, the active element may be moved toward the retracted state at the same or a different movement rate than the actuation rate. In some embodiments, the active element is actuated and moved toward the extended state or other actuated state with an actuation rate, and the active element is retracted toward the retracted state with a retraction rate. An actuation rate that is greater than the retraction rate may allow the active element to respond rapidly to an adverse condition measured by the one or more sensors, and the relatively slower retraction rate may allow the bit to re-engage with the formation without incurring the same conditions that prompted the actuation. For example, the active element may extend to the extended state in less than 0.1 second in response to a rapid increase in torque on the bit to react quickly and limit and/or prevent motor stall or stick-slip. The active element may then retract to the retracted position over 2.0 seconds to allow the bit and cutting elements of the bit to engage with the formation without the cutting elements contacting the same surfaces of the formation and producing another sudden increase in torque on the bit.

The method 844 of FIG. 8 is at least partially an iterative process, and may be used to repeatedly move an active element to increase and reduce forces applied by an active element to a formation or other workpiece. For instance, as described relative to FIG. 7, controlling the movement of an active element of the bit at 849 can include continuous, iterative, or repeated measurement of the at least one downhole parameter at 850, calculation of the difference between the measured downhole parameter and the target parameter value at 851, comparing the difference to an actuation threshold value at 853, and movement of the active element at 854. Measurements at 850 may be ongoing so that movement of the active element at 854 may result even after other measurements do not trigger movement of the active element.

Additionally, when a measured at least one downhole parameter is compared to a deactivation threshold value at 855, the method 844 may include moving the active element at 857 or may instead not move the active element. In either case, the method 844 may include returning to controlling the movement of an active element of the bit at 849 and measuring the at least one downhole parameter at 850, and proceeding to again compare the measured difference to an activation threshold or deactivation threshold value to move an active element accordingly. Additionally, for simplicity, FIG. 8 illustrates returning to controlling the movement of an active element of the bit at 849 after comparing the difference to the activation threshold value at 855. In some embodiments, however, when the active element has already been moved to apply a force (or increased force) to the workpiece at 854, the method may not compare differences of measured downhole parameters and target parameters to the actuation threshold value at 853. For instance, when an on-off valve is used to control the movement of the active element and the valve is in a position that corresponds to an extended active element that applies force to the workpiece, the method 844 may skip acts 853 and 854, such that the calculated difference is compared directly to the deactivation threshold value at 855.

Figures 1, 9:
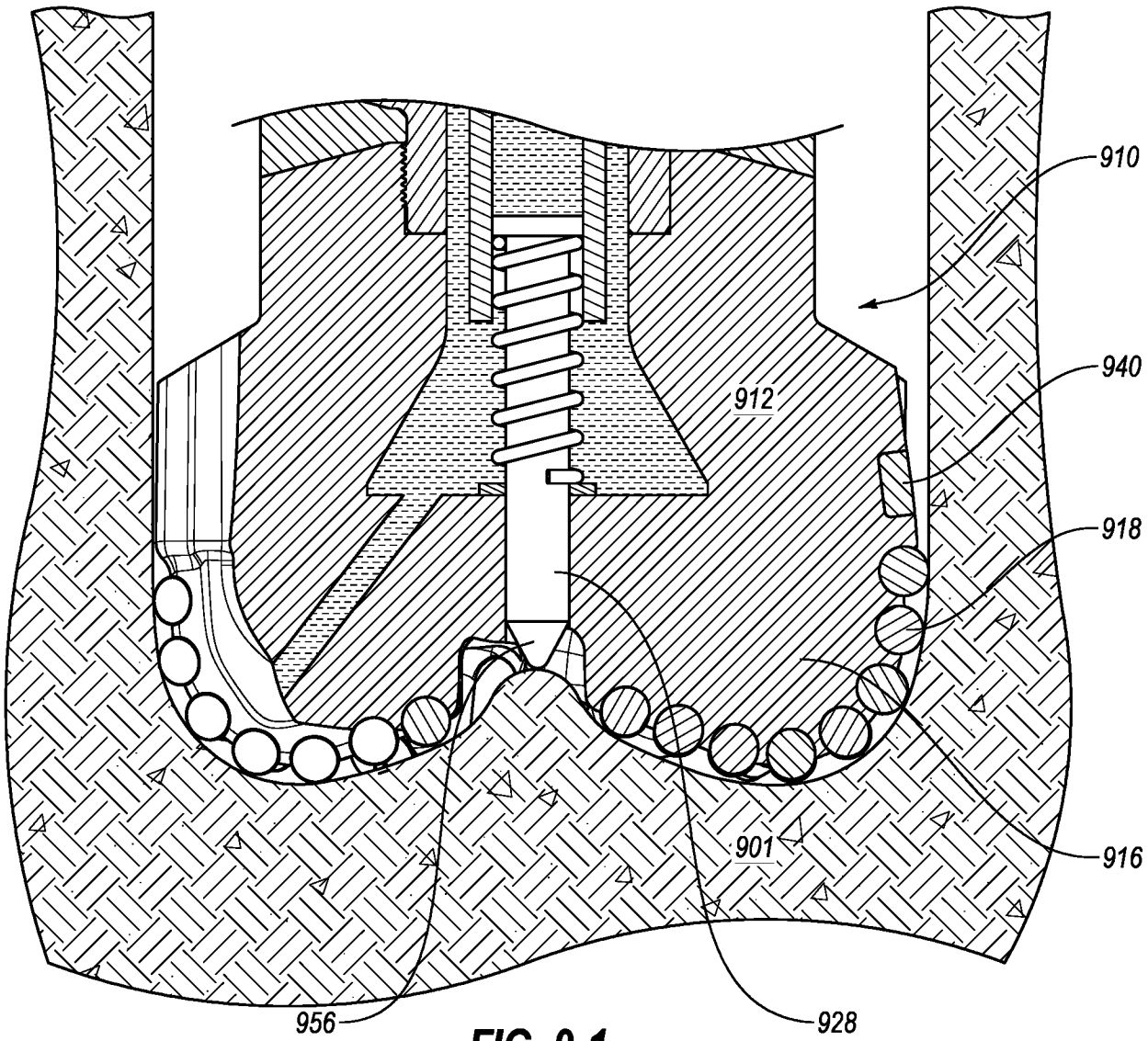
Figures 2, 9:
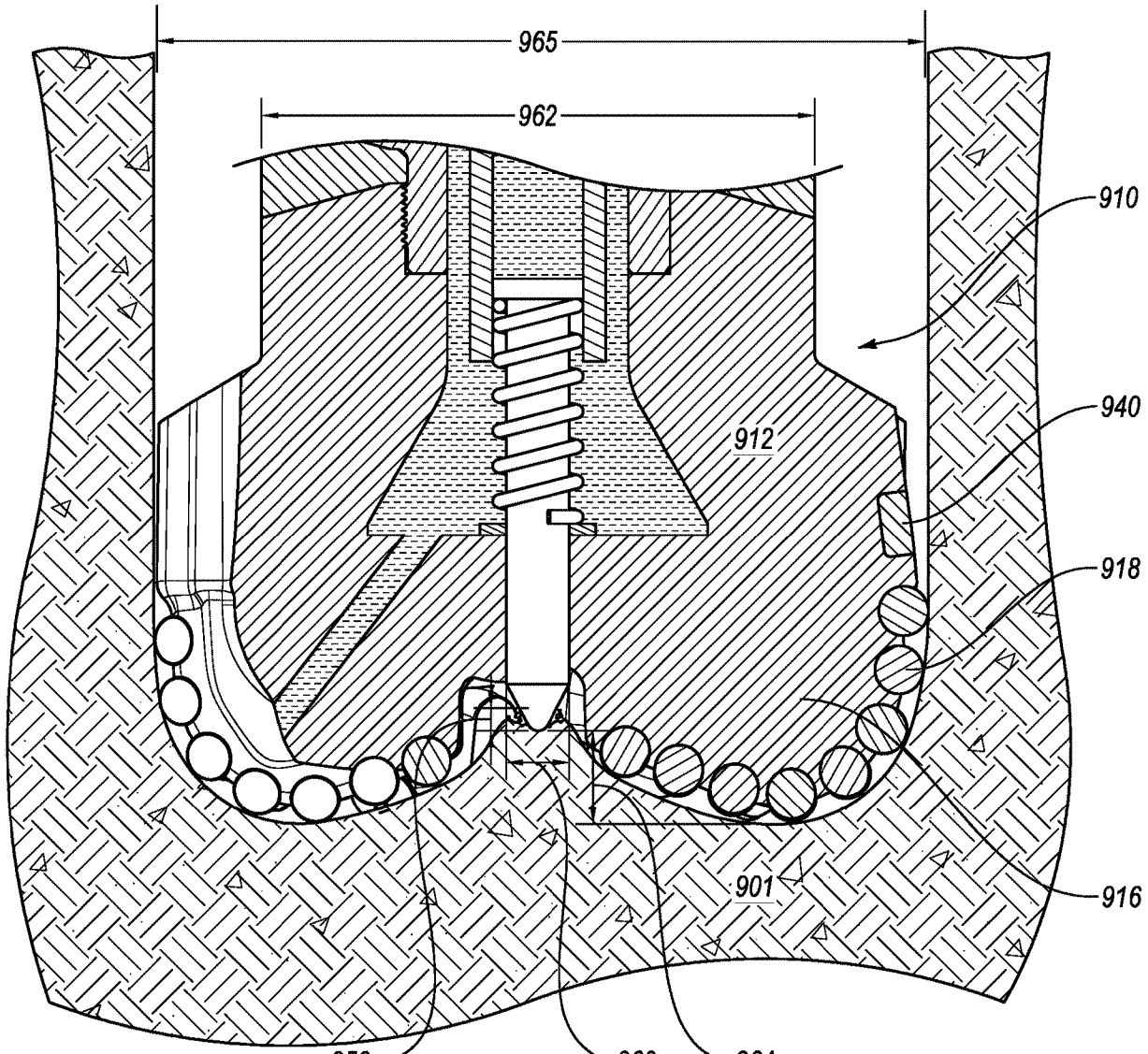

FIG. 9-1 is a side cross-sectional view an embodiment of a bit 910 with an active element 928 in a downhole environment. The bit 910 removes material from a formation 910 (or casing, downhole fish, or other workpieces) as the bit 910 rotates relative to the formation/workpiece 901. For a given WOB, a portion of the WOB is applied to the cutting structure that includes cutting elements 918. The cutting elements 918 positioned on blades 916 of the bit 910 engage with the formation 901, and the weight on the cutting structure can alter the DOC of the cutting elements 918 of the bit 910.

At least one sensor 940 positioned in the bit 910, BHA, or drill string may measure at least one downhole parameter. The active element 928 may remain in a retracted state (i.e., positioned closest to and/or within the bit body 912) during drilling operations until the sensor 940 measures a downhole parameter that exceeds a threshold value, deviates from a target parameter, or otherwise measures a value triggering actuation, as described herein. In some embodiments, the active element 928 includes an ultrahard element 956 at a downhole end of the active element 928. For example, the active element 928 may include an apexed cutting element affixed to the downhole end. When the active element 928 is in the retracted or expanded state, the apexed cutting element may engage with the formation 901 and assist the bit with tracking. The ultrahard element 956 may increase the operational lifetime and the erosion resistance of the active element 928 as the active element 928 contacts the formation 901. Although FIG. 9-1 shows the ultrahard element 956 extending outward of the face of the bit body 912 while in the retracted state, in other embodiments the ultrahard element 956 or other downhole-most portion of the active element 928 may be flush with, or recessed within, the bit face while in a retracted state.

FIG. 9-2 is a side cross-sectional view of the embodiment of a bit 910 of FIG. 9-2 after actuation of the active element 928. The active element 928 may move away from the bit body 912 and toward the formation 901 to apply a force to the formation 901. In some embodiments, the active element 928 moves a distance represented by stroke 958. The stroke 958 represents a range of motion and the distance the active element 929 moves from the retracted position (see FIG. 9-1) to the extended position (FIG. 9-2). The stroke 958 may be a range having a lower value, an upper value, or lower and upper and lower values including any of 0.1 in. (0.25 cm), 0.25 in. (0.63 cm), 0.5 in. (1.27 cm), 0.75 in. (1.91 cm), 1.0 in. (2.54 cm), 1.25 in. (3.18 cm), 1.5 in. (3.81 cm), 1.75 in. (4.45 cm), 2.0 in. (5.08 cm), or any values therebetween. In some examples, the stroke 958 is greater than 0.1 in. (0.25 cm). In other examples, the stroke 958 is less than 2.0 in. (5.08 cm). In yet other examples, the stroke 958 is between 0.1 in. (0.25 cm) and 2.0 in. (5.08 cm), between 0.25 in. (0.63 cm) and 1.75 in. (4.45 cm), or between 0.5 in. (1.27 cm) and 1.5 in. (3.81 cm). In at least one example, the stroke 958 is approximately 1.0 in. (2.54 cm). In still other examples, the stroke 958 is less than 0.1 in. (0.25 mm) or greater than 2.0 in. (5.08 cm).

In some embodiments, the activated or extended active element 928 is axially offset from the downhole tip of the cutting structure (i.e., a distance from the downhole tip of the active element 928 to the downhole-most point of the cutting elements 918 or blade 916), by a displacement distance 964. In some embodiments, the displacement distance 964 is in a range having a lower value, an upper value, or lower and upper values including any of 0.1 in. (0.25 cm), 0.25 in. (0.63 cm), 0.5 in. (1.27 cm), 0.75 in. (1.91 cm), 1.0 in. (2.54 cm), 1.25 in. (3.18 cm), 1.5 in. (3.81 cm), 1.75 in. (4.45 cm), 2.0 in. (5.08 cm), 2.5 in. (6.35 cm), 3.0 in. (7.62 cm), 5.0 in. (12.7 cm), or any values therebetween. In some examples, the displacement distance 964 is greater than 0.1 in. (0.25 cm). In other examples, the displacement distance 964 is less than 2.0 in. (5.08 cm) or less than 5.0 in. (12.7 cm). In yet other examples, the displacement distance 964 is between 0.1 in. (0.25 cm) and 5.0 in. (12.7 cm). In further examples, the extended displacement 964 is between 0.25 in. (0.63 cm) and 3.0 in. (7.62 cm), between 0.5 in. (1.27 cm) and 2.5 in. (6.35 cm), or between 0.5 in. (1.27 cm) and 1.75 in. (4.45 cm). In at least one example, the extended displacement 964 is approximately 1.0 in. (2.54 cm). In still other examples, the extended displacement 964 is less than 0.1 in. (0.25 mm) or greater than 5.0 in. (12.7 cm).

In some embodiments, the active element 928 is configured to apply a force to the formation in a range having a lower value, an upper value, or lower and upper values including any of 500 lbs. (2.22 kN), 1,000 lbs. (4.45 kN), 2,000 lbs. (8.90 kN), 4,000 lbs. (17.8 kN), 6,000 lbs. (26.7 kN), 8,000 lbs. (35.6 kN), 10,000 lbs. (44.5 kN), 15,000 lbs. (66.8 kN), 20,000 lbs. (89.0 kN), 30,000 lbs. (133.5 kN), or any values therebetween. In some examples, the force is greater than 500 lbs. (2.22 kN). In other examples, the force is less than 30,000 lbs. (133.5 kN). In yet other examples, the force is between 500 lbs. (2.22 kN) and 30,000 lbs. (133.5 kN), between 1,000 lbs. (4.45 kN) and 15,000 lbs. (66.8 kN), or between 2,000 lbs. (8.90 kN) and 20,000 lbs. (89.0 kN). In at least one example, the force is about 10,000 lbs. (44.5 kN). In still other examples, the force is less than 500 lbs. (2.22 kN) or greater than 30,000 lbs. (133.5 kN). In at least one example, the force is at least 10%, at least 20%, or at least 30% of the WOB (e.g., to reduce the total weight on the other cutting structure by at least 10%, at least 20%, or at least 30% of the WOB, respectively).

In some embodiments, the active element 928 moves from the retracted state to the actuated state (e.g., an extended state) with an actuation time in a range having an upper value, a lower value, or upper and lower values including any of 0.1 second, 0.2 second, 0.3 second, 0.4 second, 0.6 second, 0.8 second, 1.0 second, 1.5 seconds, 2.0 seconds, or any values therebetween. In some examples, the actuation time may be greater than 0.1 second. In other examples, the actuation time may be less than 2.0 seconds. In further examples, the actuation time may be less than 1.0 second. In yet further examples, the actuation time may be less than 0.5 second. In at least one example, the actuation time may be less than 0.1 second.

In some embodiments, the active element 928 moves from the actuated state (e.g., an extended state) to the retracted state with a retraction time in a range having an upper value, a lower value, or upper and lower values including any of 0.1 second, 0.2 second, 0.3 second, 0.4 second, 0.6 second, 0.8 second, 1.0 second, 1.5 seconds, 2.0 seconds, 4.0 seconds, 6.0 seconds, 8.0 seconds, 10.0 seconds, or any values therebetween. In some examples, the retraction time may be greater than 0.1 second. In other examples, the retraction time may be less than 10.0 seconds. In further examples, the retraction time may be less than 5.0 seconds, less than 2.0 seconds, or less than 1.0 second. In some embodiments, the retraction time is the same at the actuation time. In other embodiments, the retraction time is less than the actuation time. In yet other embodiments, the retraction time is greater than the actuation time. For example, the active element 928 may actuate more rapidly than the active element retracts. A slower retraction may allow the WOB and/or torque on the bit 910 to increase more gradually, limiting and/or preventing further stick-slip behavior or motor stall.

To apply the force to the formation without damaging the active element 928 or without penetrating the formation 901 too quickly to reduce the WOC on blades of the bit, it may be desirable to distribute the load on the active element 928 over a larger area. In some cases, the area of the active element 928 on which load is distributed is related to an active element diameter 960. For example, a larger active element diameter 960 (i.e., a diameter or width of the cutting end of the active element 928) may provide a larger area and allow the active element 928 to apply a greater force to formations with lower hardness or greater porosity than a small diameter active element 928 (e.g., by reducing point loading). In other examples, a smaller active element diameter 960 art the cutting end of the active element 928 may allow the active element 928 to occupy less of the bit 910, allowing the bit 910 to have a more aggressive cutting profile and greater ROP. In some embodiments, the active element diameter 960 is related to the bit body diameter 962 by a body diameter ratio in a range having a lower value, an upper value, or lower and upper values including any of 2%, 4%, 6%, 8%, 10%, 15%, 20%, 25%, 35%, or any values therebetween. In some examples, the body diameter ratio is greater than 2%. In other examples, the body diameter ratio is less than 35%. In yet other examples, the body diameter ratio is between 2% and 35%, between 4% and 25%, or between 2% and 15%. In particular examples, the body diameter ratio is about 5%, about 10%, or about 12.5%. In still other example embodiments, the body diameter ratio is less than 2% or greater than 35%

In the same or other embodiments, the active element diameter 960 (or width for a non-cylindrical active element) is related to the gage diameter 965 of the bit 910 by a gage diameter ratio in a range having a lower value, an upper value, or lower and upper values including any of 1%, 2%, 5%, 10%, 15%, 20%, 25%, or any values therebetween. In some examples, the gage diameter ratio is greater than 1%. In other examples, the gage diameter ratio is less than 25%. In yet other examples, the gage diameter ratio is between 1% and 25%, between 2% and 20%, or between 3% and 12%. In particular examples, the gage diameter ratio is about 3%, about 8.5%, or about 10%. In still other example embodiments, the gage diameter ratio is less than 1% or greater than 25%

Figure 10:
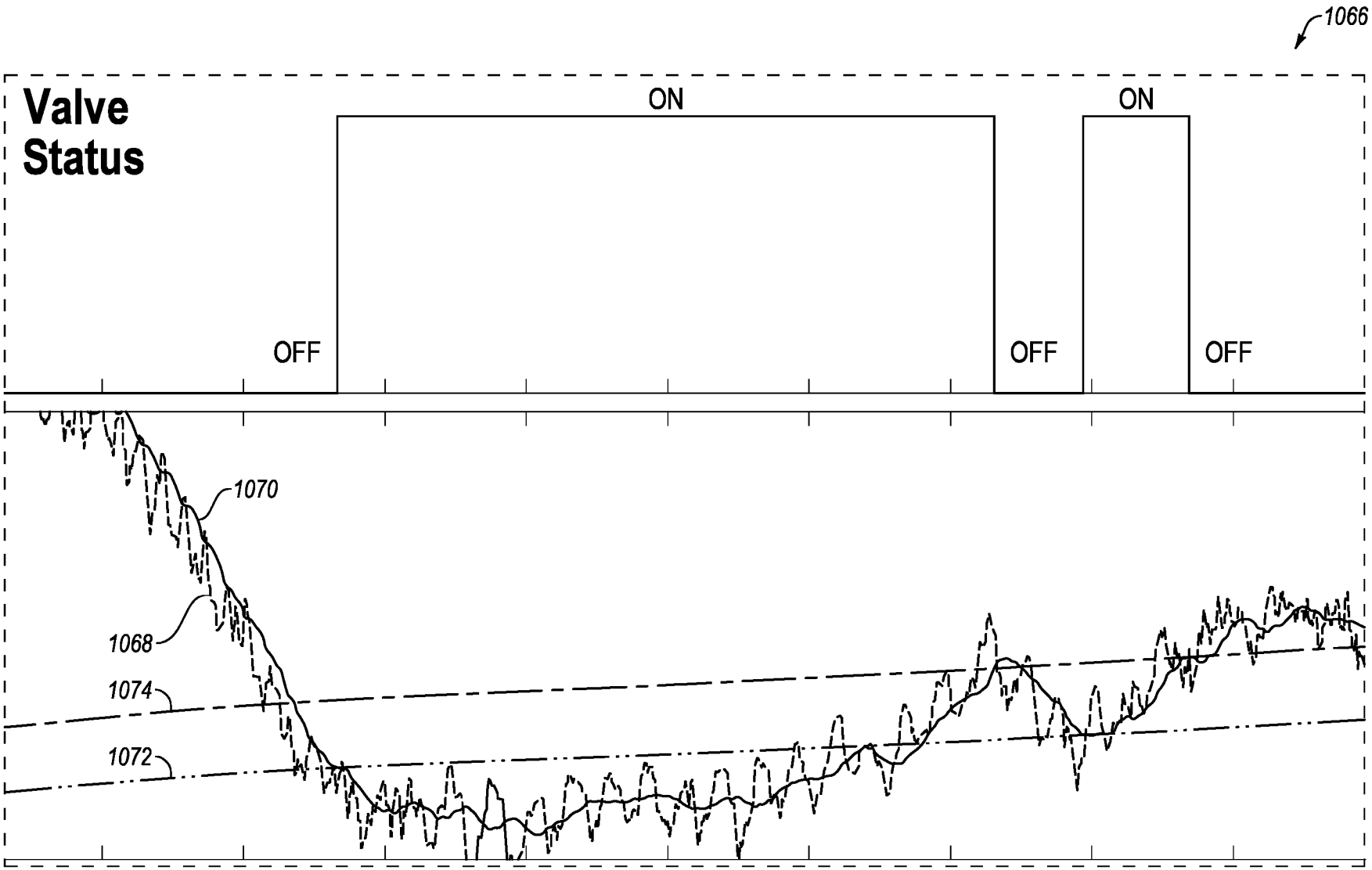
FIG. 10 is a graph illustrating a relationship of rotational speed of the bit and actuation of the active element, according to at least one embodiment of the present disclosure.

FIG. 10 is a chart 1066 illustrating an example use of a cutting tool having an active element such as described in relation to FIGS. 9-1 and 9-2, with an actuation and deactivation hysteresis behavior of the active element. The chart illustrates the instantaneous rotational speed of the bit 1068 measured over time and a first average, which in the illustrated chart 1066 is a 0.5-second rolling average 1070. As discussed herein, the rolling average 1070 may be used in some embodiments as the measured downhole parameter value used for controlling activation of one or more active elements on the cutting tool.

The first average 1070 may be compared against a second average, which in the chart 1066 is a 30-second rolling average. When the first average 1070 drops below the actuation threshold value 1072 based on the second average (e.g., exceeding 20% of a difference with the second average) at $t_1$, a valve is opened to actuate the active element. The valve remains open and the active element actuated until the first average 1070 is greater than the deactivation threshold value 1074 (e.g., less than 10% of a difference with the second average) at $t_2$. Upon closing the valve and deactivating the active element, the rotational speed of the bit 1068 begins to drop again, with the first average 1070 dropping below the actuation threshold value 1072 at $t_3$, and the valve opens again to re-actuate the active element until the rotational speed of the bit 1068 is, once again, at $t_4$ above the deactivation threshold value 1074 (e.g., less than 10% different than the second average).

The repeated and/or rapid actuation of the active element can wear the active element or an area of the bit body surrounding the active element, or deplete a downhole power source. During operations in challenging environments or drilling conditions, the active element may actuate several times per minute. When the active element actuates more than an actuation limit in a period of time, such as three times in a 30-second period, four times in a minute, five times in a minute, eight times in a 90-second period, ten times in two minutes, or other quantities of actuations within a time period, the active element may enter a sleep mode as described herein. In at least some embodiments, the sleep mode limits wear on the active element, increases the operational lifetime of the active element, or increases the operational lifetime of a downhole power source.

When in sleep mode, the active element can remain stationary relative to the bit body in either a retracted or extended position. In some examples, the active element moves to the retracted position upon entering the sleep mode. In other examples, the active element remains at a constant axial position relative to the bit body upon entering the sleep mode, even if that axial position is not the retracted position. In some embodiments, the sleep mode has a duration of at least one minute. In other embodiments, the sleep mode has a duration of at least three minutes. In yet other embodiments, the sleep mode has a duration of at least five minutes. In yet other embodiments, the sleep mode continues until the tool is tripped to surface or until a wake signal is received. The wake signal may be sent from surface or initiated downhole. For instance, an MWD may monitor the downhole conditions and determine when to wake the active element. In some embodiments, the sleep mode also disables measurements of downhole parameters, while in other embodiments, the downhole measurement of one or more downhole parameters may continue during sleep mode. In at least some embodiments, when the downhole tool enters a sleep mode, a signal may be sent to the surface, an MWD, or another location to alert an operator or tool of the sleep mode.

Figure 11:
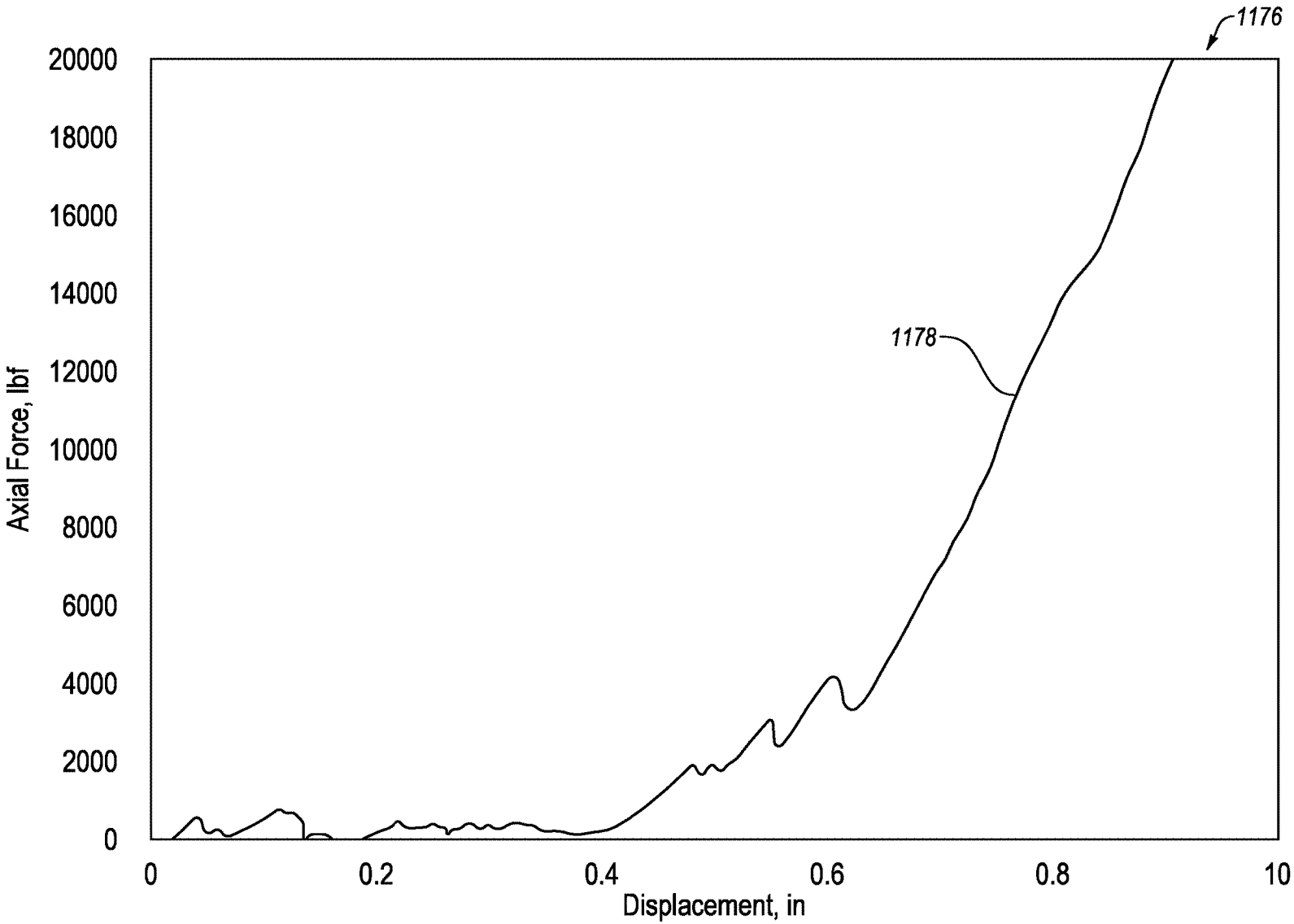
FIG. 11 is a graph illustrating force applied by an active element relative to displacement of the active element, according to at least one embodiment of the present disclosure.

In some embodiments, the relationship between the distance the active element moves and the force used to move the active element such a distance within formation is non-linear. For example, FIG. 11 is a chart 1176 illustrating a curve 1178 of an example relationship of displacement of the active element relative to the force used to move the active element and obtain the displacement. The initial movement of the active element from the retracted position may apply little or no force to the formation, as the active element may not be in contact with the formation, or the formation within the cone of the bit may be loosely consolidated and/or unsupported. The formation may, therefore, break or fracture upon contact with the active element as the active element moves towards and actuated position, as reflected by the inconsistent force applied during the initial movement of the active element. The active element can continue to move toward the actuated position and, upon further penetration and/or compression of the formation, apply increasing force. The curve 1178 illustrates a generally exponential relationship, in which an increasingly larger displacement utilizes an exponentially increasing force. In particular, the chart 1176 shows a generally flat or linear relationship for the first 0.4 in. (1.02 cm), after which the slope transitions and dramatically increases. By way of example, in the chart 1176, about 4,000 lbf (17.8 kN) is used to move the active element the first 0.6 in. (1.5 cm) or is applied to the formation by the first 0.6 in. (1.5 cm) of movement. An additional 4,000 lbf (17.8 kN), however, moves the active element only approximately an additional 0.12 in. (0.3 cm). Adding still another 4,000 lbf (17.8 kN)—or a total of 12,000 lbf (53.4 kN)—then only moves the active element about another 0.06 in. (0.15 cm).

The chart 1176 of FIG. 11 is illustrative of movement of an active element within different formations; however, the specific chart will vary based on the geometry of the cutting element, the formation hardness, the formation strength, the starting position of the active element, and the like. As an example, a relatively softer formation may allow for greater displacement with lower force, before the slope transitions to the steeper slope. In at least some embodiments, designing the bit or other cutting tool includes determining the transition for the active element for a bit and formation combination, and determining the stroke based on the transition. For instance, as significantly more force is required to move the active element after the transition, there may be diminishing returns and the bit may be designed to be displaced an additional 10%, 20%, 30%, or 40% beyond the displacement at the transition.

In at least one embodiment, a drilling system according to the present disclosure adjusts the distribution of the weight on a cutting tool to limit stick-slip behavior, motor stall, or other downhole dynamics of the drilling system. The drilling system includes one or more active elements, such as a central jack, that apply a force to the formation to decrease the portion of the WOB on the cutting structure, and reduce DOC. The active element may be actuated in response to measuring or calculating one or more downhole parameters that the indicate or predict the presence of stick-slip behavior and/or indicate conditions that may cause motor stall or damage to a downhole motor.

Embodiments of drilling systems have been primarily described with reference to wellbore drilling operations; however, the drilling systems described herein may be used in applications other than the drilling of a wellbore. In other embodiments, the drilling systems of the present disclosure may be used outside a wellbore or other downhole environment used for the exploration or production of natural resources. For instance, drilling systems of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. Further, various examples are provided as illustrations of example manners in which systems and tools of the present disclosure may be used. For instance, examples are provided of certain downhole parameters (e.g., bit rotational speed) that may be measured and compared for activation or deactivation in certain manners (e.g., comparison against top drive speed or for a specific activation duration). These examples are illustrative, and one of ordinary skill in the art will appreciate in view of the present disclosure that any of the downhole parameters described herein may be used in combination with any other activation/deactivation methods. Accordingly, any element described herein with respect to any embodiment may be used in combination with any other embodiment, except to the extent such features are described as being mutually exclusive.

Additionally, it should be understood that references to "one embodiment" or "an embodiment" of the present disclosure are not intended to be interpreted as excluding the existence of additional embodiments that also incorporate the recited features. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" refers to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A system for drilling a wellbore, the system comprising:

a bottomhole assembly (BHA) including:

a cutting tool having a body, a cutting structure comprising a plurality of cutting elements, and a longitudinal axis oriented in a longitudinal direction;

an active element connected to the body along the longitudinal axis, the active element moveable relative to the body at least partially in the longitudinal direction of the cutting tool, the active element comprising an ultrahard element;

an actuator coupled to the active element and configured to move the active element;

at least one sensor, the sensor configured to measure at least one downhole parameter; and at least one processor in communication with the at least one sensor and the actuator to move the active element based on a difference between the at least one downhole parameter and an actuation threshold or deactivation threshold value of a target parameter, wherein the actuation and deactivation threshold values are different.

2. The system of claim 1, the at least one sensor being a rotational speed sensor positioned in the BHA to measure a rotational speed of the cutting tool, and wherein the processor is further configured to calculate the difference between the at least one downhole parameter and the target parameter by comparing the rotational speed of the cutting tool to a historical value of a cutting tool rotational speed, or to a rotational speed of a torque source of the cutting tool.

3. The system of claim 1, the at least one sensor being a formation sensor configured to measure at least one formation property.

4. The system of claim 1, the at least one sensor being a force sensor positioned in the BHA and configured to measure a weight-on-bit (WOB), wherein the processor is further configured to calculate the difference between the at least one downhole parameter received from the at least one sensor and the target parameter by comparing the WOB to a target WOB.

5. The system of claim 1, the at least one sensor being a torque sensor positioned in the BHA to measure a torque on the cutting tool, wherein the processor is further configured to calculate the difference between the at least one downhole parameter received from the at least one sensor and the target parameter by comparing the torque on the cutting tool to a torque applied by a torque source.

6. The system of claim 1, further comprising a downhole motor that provides torque to rotate the bit, the at least one sensor including one or more pressure sensor positioned to measure a pressure drop across the downhole motor.

7. The system of claim 1, the active element having a maximum stroke between 0.1 in. (0.25 cm) and 1.5 in. (3.81).

8. A system for drilling a wellbore, the system comprising:

a bit having a longitudinal axis about which the bit is rotatable;

an active element positioned in the bit, the active element moveable relative to the bit along the longitudinal axis;

an actuator that applies a force to the active element to move the active element;

at least one sensor configured to measure at least one downhole parameter; and a processor in communication with the at least one sensor and the actuator to move the active element toward an extended state when the at least one downhole parameter exceeds an actuation threshold value and move the active element toward a retracted state when the at least one downhole parameter is within a deactivation threshold value, and wherein the actuation threshold value is different from the deactivation threshold value.

9. The system of claim 8, the deactivation threshold value being closer to a target parameter than the activation threshold value.

10. The system of claim 8, the at least one sensor being a first sensor, the at least one downhole parameter being a first downhole parameter, and the actuation threshold value being a first actuation threshold value, the system further comprising:

a second sensor, where the processor is configured to actuate the actuator to move the active element a first distance when the first downhole parameter exceeds the first actuation threshold value, and the processor is configured to move the active element a second distance when a second downhole parameter from the second sensor exceeds a second actuation threshold value.

11. The system of claim 8, the at least one downhole parameter being a first downhole parameter and the actuation threshold value being a first actuation threshold value, the processor further being configured to move the active element a first distance when the first downhole exceeds the first actuation threshold value, and the processor is configured to move the active element a second distance when a second downhole parameter exceeds a second actuation threshold value.

12. The system of claim 11, the first downhole parameter and the second downhole parameter being the same downhole parameter, and the first actuation threshold value and the second actuation threshold value are different magnitudes for the same downhole parameter.

13. A method of controlling a bit, comprising:

tripping the bit into a downhole environment, the bit having an active element that is movable relative to the bit along a longitudinal axis of the bit;

applying torque to the bit in the downhole environment;

measuring a rotational speed of the bit;

comparing the rotational speed against a target parameter value; and when the rotational speed is beyond an actuation threshold value of the target parameter value and/or within a deactivation threshold value of the target parameter, moving the active element relative to the bit, wherein the actuation threshold value is different from the deactivation threshold value.

14. The method of claim 13, wherein moving the active element relative to the bit includes controlling a valve between a closed state and at least one open state and thereby applying a hydraulic force that moves the active element.

15. The method of claim 13, the target parameter value being a rolling average of the rotational speed.

16. The method of claim 15, the rolling average being a first rolling average and the actuation threshold value being a first actuation threshold value, wherein comparing the rotational speed against the target parameter value includes:

calculating a second rolling average of the rotational speed, the first rolling average and second rolling average being averaged over different time periods; and comparing the second rolling average to the first actuation threshold value or to a second actuation threshold value.

17. The method of claim 16, wherein moving the active element relative to the bit includes moving the active element relative to the bit when either the second rolling average exceeds the first actuation threshold value, or the second rolling average exceeds the second actuation threshold value.

18. The method of claim 13, the bit including a cutting structure separate from the active element, wherein the cutting structure separate from the active element is axially fixed relative to the longitudinal axis of the bit.

* * * * *